US008771016B2

(12) United States Patent
Atkinson et al.

(10) Patent No.: US 8,771,016 B2
(45) Date of Patent: Jul. 8, 2014

(54) HIGH BANDWIDTH CONNECTOR

(75) Inventors: Prescott B. Atkinson, Nottingham, NH (US); Mark W. Gailus, Concord, MA (US); Mark G. Hanrahan, Milford, NH (US)

(73) Assignee: Amphenol Corporation, Wallingford Center, CT (US)

( * ) Notice: Subject to any disclaimer, the term of this patent is extended or adjusted under 35 U.S.C. 154(b) by 295 days.

(21) Appl. No.: 13/034,670

(22) Filed: Feb. 24, 2011

(65) Prior Publication Data

US 2011/0230096 A1 Sep. 22, 2011

Related U.S. Application Data

(60) Provisional application No. 61/307,824, filed on Feb. 24, 2010.

(51) Int. Cl.
*H01R 13/648* (2006.01)

(52) U.S. Cl.
USPC ..... 439/607.07; 439/701

(58) Field of Classification Search
USPC ..... 439/607.01, 607.02, 701
See application file for complete search history.

(56) References Cited

U.S. PATENT DOCUMENTS

| | | | |
|---|---|---|---|
| 2,996,710 | A | 8/1961 | Pratt |
| 3,002,162 | A | 9/1961 | Garstang |
| 3,134,950 | A | 5/1964 | Cook |
| 3,322,885 | A | 5/1967 | May et al. |
| 3,786,372 | A | 1/1974 | Epis et al. |
| 3,825,874 | A | 7/1974 | Peverill |
| 3,863,181 | A | 1/1975 | Glance et al. |
| 4,155,613 | A | 5/1979 | Brandeau |
| 4,195,272 | A | 3/1980 | Boutros |
| 4,276,523 | A | 6/1981 | Boutros et al. |
| 4,371,742 | A | 2/1983 | Manly |

(Continued)

FOREIGN PATENT DOCUMENTS

| | | |
|---|---|---|
| EP | 1 779 472 A1 | 5/2007 |
| EP | 2 169 770 A2 | 3/2010 |

(Continued)

OTHER PUBLICATIONS

International Search Report for PCT/US2011/026139 dated Nov. 22, 2011.

(Continued)

*Primary Examiner* — Hien Vu
(74) *Attorney, Agent, or Firm* — Wolf, Greenfield & Sacks, P.C.

(57) ABSTRACT

An improved open pin field connector is provided for enhanced performance when carrying high speed signals by selective application of one or more techniques for controlling electrical performance parameters. Lossy material may be positioned adjacent to conductive elements of the connector so as to reduce resonance in pairs of conductive elements and/or to provide a desired characteristic impedance for pairs of differential signal conductors. The lossy material may be shaped and positioned to avoid capacitive coupling that might otherwise increase cross talk. In a right angle connector, the lossy material may have a step-wise increase in thickness to provide comparable loss along longer and shorter conductive elements. Conductive elements may be shaped to balance performance characteristics of pairs selected to carry differential signals regardless of orientation along a row or column. Alternatively, conductive elements may have narrowed regions, covered with lossy portions, for reducing resonance while supporting DC signal propagation.

48 Claims, 26 Drawing Sheets

(56) References Cited

U.S. PATENT DOCUMENTS 4,408,255 A 10/1983 Adkins
4,447,105 A 5/1984 Ruehl
4,471,015 A 9/1984 Ebneth et al.
4,484,159 A 11/1984 Whitley
4,490,283 A 12/1984 Kleiner
4,518,651 A 5/1985 Wolfe, Jr.
4,519,664 A 5/1985 Tillotson
4,519,665 A 5/1985 Althouse et al.
4,636,752 A 1/1987 Saito
4,682,129 A 7/1987 Bakermans et al.
4,751,479 A 6/1988 Parr
4,761,147 A 8/1988 Gauthier
4,846,724 A 7/1989 Sasaki et al.
4,878,155 A 10/1989 Conley
4,948,922 A 8/1990 Varadan et al.
4,970,354 A 11/1990 Iwasa et al.
4,992,060 A 2/1991 Meyer
5,000,700 A 3/1991 Masubuchi et al.
5,141,454 A 8/1992 Garrett et al.
5,150,086 A 9/1992 Ito
5,168,252 A 12/1992 Naito
5,168,432 A 12/1992 Murphy et al.
5,266,055 A 11/1993 Naito et al.
5,280,257 A 1/1994 Cravens et al.
5,287,076 A 2/1994 Johnescu et al.
5,340,334 A 8/1994 Nguyen
5,346,410 A 9/1994 Moore, Jr.
5,456,619 A 10/1995 Belopolsky et al.
5,461,392 A 10/1995 Mott et al.
5,499,935 A 3/1996 Powell
5,551,893 A 9/1996 Johnson
5,562,497 A 10/1996 Yagi et al.
5,597,328 A 1/1997 Mouissie
5,651,702 A 7/1997 Hanning et al.
5,669,789 A 9/1997 Law
5,796,323 A 8/1998 Uchikoba et al.
5,831,491 A 11/1998 Buer et al.
5,924,899 A 7/1999 Paagman
5,981,869 A 11/1999 Kroger
5,982,253 A 11/1999 Perrin et al.
6,019,616 A 2/2000 Yagi et al.
6,152,747 A 11/2000 McNamara
6,168,469 B1 1/2001 Lu
6,174,203 B1 1/2001 Asao
6,174,944 B1 1/2001 Chiba et al.
6,217,372 B1 4/2001 Reed
6,299,483 B1 10/2001 Cohen et al.
6,347,962 B1 2/2002 Kline
6,350,134 B1 2/2002 Fogg et al.
6,364,711 B1 4/2002 Berg et al.
6,375,510 B2 4/2002 Asao
6,379,188 B1 4/2002 Cohen et al.
6,398,588 B1 6/2002 Bickford
6,409,543 B1 6/2002 Astbury, Jr. et al.
6,482,017 B1 11/2002 Van Doorn
6,503,103 B1 1/2003 Cohen et al.
6,506,076 B2 1/2003 Cohen et al.
6,517,360 B1 2/2003 Cohen
6,530,790 B1 3/2003 McNamara et al.
6,537,087 B2 3/2003 McNamara et al.
6,554,647 B1 4/2003 Cohen et al.
6,565,387 B2 5/2003 Cohen
6,579,116 B2 6/2003 Brennan et al.
6,595,802 B1 7/2003 Watanabe et al.
6,602,095 B2 8/2003 Astbury, Jr. et al.
6,616,864 B1 9/2003 Jiang et al.
6,652,318 B1 11/2003 Winings et al.
6,655,966 B2 12/2003 Rothermel et al.
6,709,294 B1 3/2004 Cohen et al.
6,713,672 B1 3/2004 Stickney
6,743,057 B2 6/2004 Davis et al.
6,776,659 B1 8/2004 Stokoe et al.
6,786,771 B2 9/2004 Gailus
6,814,619 B1 * 11/2004 Stokoe et al. ..... 439/607.07
6,872,085 B1 3/2005 Cohen et al.
6,979,226 B2 * 12/2005 Otsu et al. ..... 439/607.07
7,044,794 B2 5/2006 Consoli et al.
7,057,570 B2 6/2006 Irion, II et al.
7,074,086 B2 7/2006 Cohen et al.
7,094,102 B2 8/2006 Cohen et al.
7,108,556 B2 9/2006 Cohen et al.
7,163,421 B1 1/2007 Cohen et al.
7,285,018 B2 10/2007 Kenny et al.
7,335,063 B2 2/2008 Cohen et al.
7,371,117 B2 5/2008 Gailus
7,494,383 B2 2/2009 Cohen et al.
7,540,781 B2 6/2009 Kenny et al.
7,581,990 B2 9/2009 Kirk et al.
7,588,464 B2 9/2009 Kim
7,722,401 B2 5/2010 Kirk et al.
7,731,537 B2 6/2010 Amleshi et al.
7,753,731 B2 * 7/2010 Cohen et al. ..... 439/607.09
7,771,233 B2 8/2010 Gailus
7,794,240 B2 9/2010 Cohen et al.
7,811,128 B2 * 10/2010 Pan ..... 439/607.05
7,874,873 B2 1/2011 Do et al.
7,887,371 B2 2/2011 Kenny et al.
7,906,730 B2 3/2011 Atkinson et al.
7,914,304 B2 3/2011 Cartier et al.
7,931,500 B2 * 4/2011 Knaub et al. ..... 439/607.07
8,083,553 B2 12/2011 Manter et al.
8,182,289 B2 * 5/2012 Stokoe et al. ..... 439/607.11
8,215,968 B2 7/2012 Cartier et al.
8,272,877 B2 9/2012 Stokoe et al.
8,371,875 B2 2/2013 Gailus
8,382,524 B2 2/2013 Khilchenko et al.
2001/0042632 A1 11/2001 Manov et al.
2002/0042223 A1 4/2002 Belopolsky et al.
2002/0089464 A1 7/2002 Joshi
2002/0098738 A1 7/2002 Astbury et al.
2002/0111068 A1 8/2002 Cohen et al.
2002/0111069 A1 8/2002 Astbury et al.
2004/0020674 A1 2/2004 McFadden et al.
2004/0115968 A1 6/2004 Cohen
2004/0121652 A1 6/2004 Gailus
2004/0196112 A1 10/2004 Welbon et al.
2004/0259419 A1 12/2004 Payne et al.
2005/0070160 A1 3/2005 Cohen et al.
2005/0133245 A1 6/2005 Katsuyama et al.
2005/0176835 A1 8/2005 Kobayashi et al.
2005/0283974 A1 12/2005 Richard et al.
2005/0287869 A1 12/2005 Kenny et al.
2006/0068640 A1 3/2006 Gailus
2007/0004282 A1 1/2007 Cohen et al.
2007/0021001 A1 1/2007 Laurx et al.
2007/0037419 A1 2/2007 Sparrowhawk
2007/0042639 A1 2/2007 Manter et al.
2007/0054554 A1 3/2007 Do et al.
2007/0059961 A1 3/2007 Cartier et al.
2007/0218765 A1 9/2007 Cohen et al.
2008/0194146 A1 8/2008 Gailus
2008/0246555 A1 10/2008 Kirk et al.
2008/0248658 A1 10/2008 Cohen et al.
2008/0248659 A1 10/2008 Cohen et al.
2008/0248660 A1 10/2008 Kirk et al.
2009/0011641 A1 1/2009 Cohen et al.
2009/0011645 A1 1/2009 Laurx et al.
2009/0117386 A1 5/2009 Vacanti et al.
2009/0239395 A1 9/2009 Cohen et al.
2009/0291593 A1 11/2009 Atkinson et al.
2010/0081302 A1 4/2010 Atkinson et al.
2010/0294530 A1 11/2010 Atkinson et al.
2011/0003509 A1 1/2011 Gailus
2011/0230095 A1 9/2011 Atkinson et al.
2011/0287663 A1 11/2011 Gailus et al.
2012/0094536 A1 4/2012 Khilchenko et al.
2012/0156929 A1 6/2012 Manter et al.
2012/0202363 A1 8/2012 McNamara et al.
2012/0202386 A1 8/2012 McNamara et al.
2013/0012038 A1 1/2013 Kirk et al.
2013/0017733 A1 1/2013 Kirk et al.
2013/0078870 A1 3/2013 Milbrand, Jr.

(56) References Cited

U.S. PATENT DOCUMENTS

| | | | |
|---|---|---|---|
| 2013/0109232 | A1 | 5/2013 | Paniaqua |
| 2013/0196553 | A1 | 8/2013 | Gailus |
| 2013/0225006 | A1 | 8/2013 | Khilchenko et al. |

FOREIGN PATENT DOCUMENTS

| | | | |
|---|---|---|---|
| GB | 1272347 | A | 4/1972 |
| JP | 07302649 | A | 11/1995 |
| WO | WO 88/05218 | A1 | 7/1988 |
| WO | WO 2004/059794 | A2 | 7/2004 |
| WO | WO 2004/059801 | A1 | 7/2004 |
| WO | WO 2006/039277 | A1 | 4/2006 |
| WO | WO 2007/005597 | A2 | 1/2007 |
| WO | WO 2007/005599 | A1 | 1/2007 |
| WO | WO 2008/124057 | A1 | 10/2008 |

OTHER PUBLICATIONS

Extended European Search Report for EP 11166820.8 mailed Jan. 24, 2012.

International Search Report with Written Opinion for International Application No. PCT/US06/25562 dated Oct. 31, 2007.

International Search Report and Written Opinion from PCT Application No. PCT/US2005/034605 dated Jan. 26, 2006.

International Search Report and Written Opinion for International Application No. PCT/US2010/056482 issued Mar. 14, 2011.

International Preliminary Report on Patentability for International Application No. PCT/US2010/056482 issued May 24, 2012.

International Search Report and Written Opinion for PCT/US2011/026139 dated Nov. 22, 2011.

International Preliminary Report on Patentability for PCT/US2011/026139 dated Sep. 7, 2012.

International Search Report and Written Opinion for International Application No. PCT/US2011/034747 dated Jul. 28, 2011.

PCT Search Report and Written Opinion for Application No. PCT/US2012/023689 mailed on Sep. 12, 2012.

International Preliminary Report on Patentability for Application No. PCT/US2012/023689 mailed on Aug. 15, 2013.

International Search Report and Written Opinion for PCT/US2012/060610 dated Mar. 29, 2013.

[No Author Listed] "Carbon Nanotubes for Electromagnetic Interference Shielding," SBIR/STTR. Award Information. Program Year 2001. Fiscal Year 2001. Materials Research Institute, LLC. Chu et al. Available at http://sbir.gov/sbirsearch/detail/225895. Last accessed Sep. 19, 2013.

Beaman, High Performance Mainframe Computer Cables, Electronic Components and Technology Conference, 1997, pp. 911-917.

Shi et al, "Improving Signal Integrity in Circuit Boards by Incorporating Absorbing Materials," 2001 Proceedings. 51st Electronic Components and Technology Conference, Orlando FL. 2001:1451-56.

* cited by examiner

HIGH BANDWIDTH CONNECTOR

RELATED APPLICATION

This application claims the benefit of U.S. Provisional Patent Application Ser. No. 61/307,824, filed Feb. 24, 2010, entitled "High Bandwidth Connector," by Gailus et al., which is hereby incorporated by reference in its entirety.

BACKGROUND OF INVENTION

1. Field

Aspects described relate generally to electrical interconnection systems and more specifically to improved signal integrity in interconnection systems.

2. Discussion of Related Art

In various electrical interconnection systems, separable multi-pin connectors are commonly used. Single-ended and differential pair electrical paths that carry signals in the 1 to 20 Gigabit per second range are provided by signal carrying structures such as cables or integrated circuit packages. Such electrical paths are often present between circuit boards, such as a daughter card and a backplane. Accordingly, separable connectors that carry signals at frequencies in this range are known. Though, it can frequently be a challenge in designing an electrical connector to provide a suitable number of signal paths in a relatively confined area in which all of the signal paths have electrical properties that support a desired level of performance for an overall electronic system.

In situations where a connector does not have pre-designated signal or ground conductors, the connector may be referred to as an "open pin field connector." For open pin field connectors, electrical characteristics of the connectors, such as insertion loss, signal reflections due to impedance mismatch, crosstalk between different signal conductors, or the like, may be controlled by appropriately choosing how connector pins are assigned. For example, some connector pins may be assigned to carry signals or may be paired to carry differential signals. Some connector pins may be assigned to serve as high frequency digital ground connections. These grounds may be connected to earth ground or may carry a fixed voltage power supply or power return. In some cases, digital ground connections are used simultaneously with power return connections. Also, some signals are assigned to carry relatively low speed signals.

In an open pin field connector, pin assignments may be made to separate high speed signal conductors or to surround high speed signal conductors with grounds. For example, if a connector includes conductive pins that are arranged in a two dimensional rectangular array of rows and columns, it is possible to assign pairs of horizontally adjacent conductors to serve as the plus and minus signal pins for a differential signal in an alternating pattern with pairs of horizontally adjacent ground return pins. The pattern of signal pins may be staggered by two positions from row to row. Such an arrangement provides a differential pair and ground pair checkerboard pattern. Similar configurations may arise for vertically paired signal conductors and paired grounds.

An alternative approach to achieving desired electrical properties for signal paths through an electrical connector is to designate certain conductors within the connector to carry signals and others to be connected to ground. When it is known a priori which conductors are to carry signals and which are to be connected to ground, the shape and position of the conductors can be tailored to their function. For example, signal conductors designated to be a pair to carry a differential signal may be routed close to each other. Conductors designated to be connected to ground may be made wider than those carrying high speed signals and may be positioned to shield high speed signals.

Also, when the intended functions of conductors in a connector are pre-assigned, lossy material may be incorporated into the connector to increase performance of the connector. The lossy material, for example, may contact the ground conductors as a way to reduce resonances in the connector.

Though connectors with conductors having pre-assigned functions may provide better performance, historically, many connectors have been open pin field connectors. Open pin field connectors provide greater flexibility to designers of electronic systems. Moreover, once a system has been designed with a connector, it is desirable if upgrades to that system use the same connector or compatible connector to allow older and newer components to be interconnected. For these and other reasons, open pin field connectors are still widely used.

SUMMARY

An improved open pin field connector may be provided through a combination of one more design techniques. These techniques may provide suitable values of properties such as cross talk, impedance and/or insertion loss, regardless of which conductive elements in the connector are used to carry high speed signals and which are used as ground conductors or to carry low speed signals.

One such technique may involve selective placement of lossy material adjacent to conductive elements within the connector. In some embodiments, the lossy material is included in a multi-pin, open pin field connector. In embodiments in which there are no conductive elements specifically designed to be signal or ground conductors, the lossy material may be placed adjacent to some conductive elements, even if those conductive elements may be used to carry signals. In some embodiments, the lossy material may be selectively placed to have a comparable effect on all of the conductive elements such that any conductive element of the connector will exhibit suitable performance characteristics whether designated to be a signal or ground conductor. In addition, any pair of conductive elements may be designated as a conductive pair to carry a differential signal.

Various placements of lossy material in the electrical connector, such as adjacent to conductive elements, are suitable. In some embodiments, the lossy material may also be used to fill regions between conductive elements. The positioning of the lossy material relative to conductive elements may be selected to reduce resonance in pairs of conductive elements if used as grounds without causing an unacceptable decrease in signal conductive elements used to carry signals.

Moreover, regions of lossy material may be positioned and/or shaped to contribute to a desired characteristic impedance for pairs of signal conductors, if used to carry a differential signal. In some embodiments, conductive elements are elongated in the column direction relative to their thickness in the row direction, and the lossy material may be placed between the columns.

Alternatively or additionally, the lossy material may be shaped to control coupling between conductive elements, which may contribute to cross talk if those conductive elements carry signals. In some embodiments, the lossy material may be formed as a plurality or separate strips or a planar member comprising a plurality of slots that define strips as a way to control characteristic impedance. The strips may be positioned to follow the contours of conductive elements. Alternatively or additionally, the slots may be positioned between conductive elements. Such strips may be placed symmetrically on both sides of a column of conductive elements.

Though, in some embodiments, the lossy material may be positioned adjacent portions of conductive elements in the connector, such as by surrounding an insulative portion that covers the conductive elements. In some cases, the lossy material, though being in close proximity to the conductive elements, does not contact the conductive elements.

In yet other embodiments, the lossy material partially or completely covers the conductive elements of the connector. In some cases, the lossy material may be in contact with the conductive elements.

Alternatively or additionally, the amount of loss introduced by the lossy material may be increased by forming gaps in the conductive elements. Gap regions may exist between conductive members of conductive elements of the connector. The lossy material may be placed in such gap regions between conductive members, where the lossy material contacts the conductive members and forms a connection between the conductive members.

In some embodiments, conductive members of conductive elements of the connector may include a narrow bridging portion. Such a narrow bridging portion may support DC signal propagation. For conductive elements that have narrow bridging portions, lossy material may be placed around the narrow bridging portion, contacting ends of the conductive members and the narrow bridging portion.

Another technique that alternatively or additionally may be used entails the selection of a relative dielectric constant of material separating conducting elements. An effective dielectric constant of material separating conductive elements may be selected in proportion to the spacing between those elements. Materials and constructions techniques may be used to provide a higher dielectric constant between conductive elements that are separated by a greater distance. Higher dielectric constant may be provided by using high dielectric constant material in a connector housing, such as materials that have a relative dielectric constant of 3 or higher. Alternatively or additionally, a difference in effective dielectric constant may be achieved by introducing low dielectric constant material such as air between conductive elements that are closer together. Controlling the effective dielectric constant may be used to equalize the characteristic impedance of any arbitrary pair of adjacent conductive elements in scenarios in which the spacing between conductive elements is different in different dimensions in the connector.

A further technique for equalizing the characteristic impedance spacing between conductive elements is different in different dimensions in the connector may entail selective positioning of a lossy material so as to occupy space between adjacent conductive elements that have a wider separation. Such a technique may employ lossy material that is a lossy conductor.

A further technique that alternatively or additionally may be used entails selecting appropriate shape of conductive elements. A width of the conductive elements may be reduced relative to a standard connector in scenarios in which the conductive elements, though positioned in a regular array in which on-center spacing is uniform in all directions, have a thickness less than their width. Such a scenario may occur when the conductive elements are stamped from a sheet of metal.

In an illustrative embodiment, an electrical connector is provided. The electrical connector includes a plurality of columns, each column comprising a plurality of conductive elements; and lossy material disposed adjacent the conductive elements of each of the plurality of columns, wherein the plurality of columns and the lossy material are adapted and configured such that conductive elements provide differential signal conducting paths having a nominal impedance, with signal paths formed from adjacent conductive elements in the same column having an impedance no less than 80% of the nominal impedance and signal paths formed from adjacent conductive elements in adjacent columns having an impedance no greater than 120% of the nominal impedance.

In another illustrative embodiment, an electrical connector is provided. The electrical connector includes a plurality of columns, each column comprising a plurality of conductive elements; a plurality of insulative regions, each insulative region being associated with a respective column; lossy material disposed in a plurality of lossy regions, wherein for each of the plurality of columns, the respective insulative region is symmetrically disposed on a first side of the column and a second side of the column about a longitudinal axis; and a first lossy region is disposed on the first side of the column and a second lossy region is disposed on the second side of the column, the second lossy region being symmetrical with the first lossy region about the longitudinal axis.

In a further illustrative embodiment, a wafer for an electrical connector is provided. The wafer includes a plurality of conductive elements disposed in a column; and at least one lossy member disposed adjacent to the column, the at least one lossy member comprising: a plurality of strips of lossy material, each strip following a contour of a respective conductive element of the plurality of conductive elements, and a plurality of regions free of the lossy material separating adjacent strips of the plurality of strips.

In yet another illustrative embodiment, an electrical connector is provided. The electrical connector includes a plurality of columns of conductive elements, each of the plurality of columns comprising a plurality of conductive elements; lossy material, wherein for each of the plurality of columns: the lossy material is disposed adjacent to a portion of the plurality of conductive elements, the portion comprising at least a first conductive element, a second conductive element and a third conductive element, and the lossy material is separated from the first conductive element by a first distance, the lossy material is separated from the second conductive element by a second distance greater than the first distance, and the lossy material is separated from the third conductive element by a third distance greater than the second distance.

In a further illustrative embodiment, an electrical connector is provided. The electrical connector includes a plurality of columns, each column comprising a plurality of conductive elements, each conductive element comprising a contact tail, a mating contact portion and an intermediate portion joining the contact tail and the mating contact portion, wherein at least a portion of the plurality of conductive elements each has an intermediate portion having at least one narrowed portion; and a plurality of regions of lossy material, each region being disposed on a conductive element of the plurality of conductive elements adjacent a narrowed portion.

In another illustrative embodiment, a wafer for an electrical connector is provided. The wafer includes a plurality of conductive elements disposed in a column, at least a portion of the plurality of conductive elements having a narrowed portion; and a plurality of regions of lossy material, each region being electrically connected to a respective conductive element of the plurality of conductive elements adjacent the narrowed portions of the respective conductive element.

The foregoing is a partial summary of the inventive concepts described herein and illustrated in the accompanying drawings.

BRIEF DESCRIPTION OF DRAWINGS

The accompanying drawings are not intended to be drawn to scale. In the drawings, each identical or nearly identical component that is illustrated in various figures is represented by a like numeral. For purposes of clarity, not every component may be labeled in every drawing. In the drawings.

DETAILED DESCRIPTION

Figure 1:
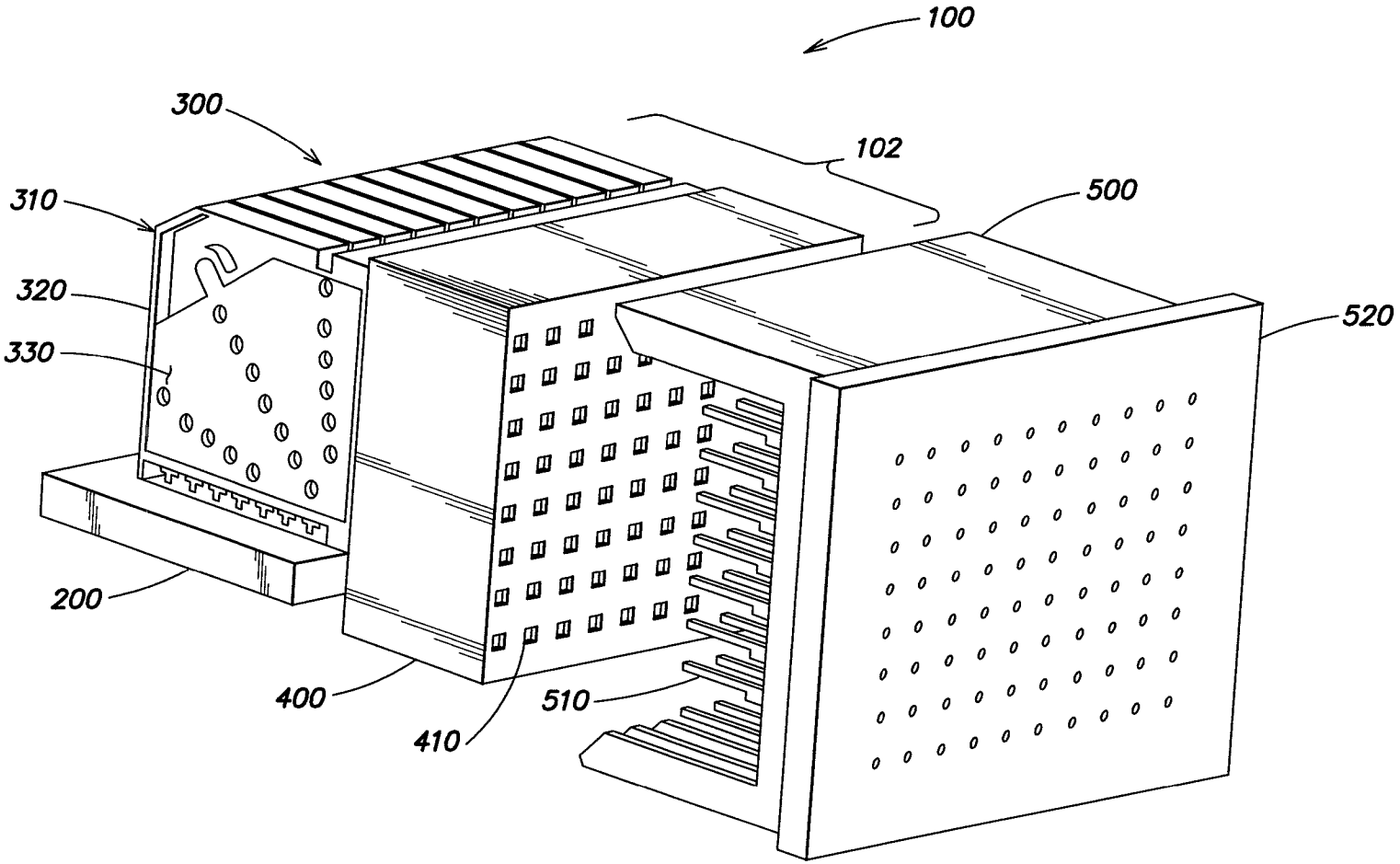
FIG. 1 is a perspective view of an electrical interconnection system in accordance with some embodiments.

The inventors have recognized and appreciated that an open pin field connector with desirable electrical and mechanical properties may be achieved through the use of one or more construction techniques.

These techniques may be used in a suitable combination that may simultaneously provide desired impedance, cross talk, insertion loss or other electrical properties for signal paths through a connector. In some embodiments, these techniques may be applied to an open pin field connector such that one or more of these electrical properties may be uniform, to within some tolerance, for any signal conductors within the connector. As a specific example, techniques as described herein may be used to provide an open pin field connector, constructed in accordance with the HM standard, that provides a characteristic impedance with acceptable cross talk and insertion loss over a frequency range that is sufficient to support data rates at 10 Gbps or greater, regardless of which pair of adjacent conductors are selected to carry such a signal.

These construction techniques may include the selective placement of lossy materials. The inventors have recognized that, in some cases, for connectors that are used for signals having frequency components that are over approximately 1 GHz, undesirable resonances may be present. Such resonances may involve standing wave patterns of voltages and currents, particularly in conductors that are assigned as ground return conductors. Resonances present in such conductors may produce effects such as dips in signal magnitude versus frequency transmission response, peaks in signal reflection and crosstalk responses, and peaks in radiated electromagnetic emissions from the equipment incorporating the connector.

Apparatuses and methods for significantly reducing these effects of resonances in connectors while preserving flexibility in the assignment of individual pins to signal or signal ground return functions, are presented herein. In some embodiments, flexibility is preserved in the assignment of individual pins to fixed voltage power or power return uses or for assignment to carry low speed signals. Such flexibility may be provided, for example, by providing comparable amounts of loss for all of the conductive elements within a connector and/or providing the lossy material in an electrically floating configuration. When floating, the lossy material may not be electrically connected within the connector to any of the conductive elements.

Further, to support use of an open pin field connector for high speed signals, one or more techniques may be used to provide uniform impedance, over the operating range of interest, for any pair of adjacent conductive elements, regardless of whether those conductive elements are aligned in a row direction or column direction. In some embodiments, those techniques may include providing a shape to intermediate portions of conductive elements in a connector that that provides approximately uniform dimensions in a row and column dimension.

In embodiments in which the conductive elements are stamped from a sheet of metal, providing a width that is comparable to the thickness of the metal may be impractical. Rather, the conductive elements may be wider in a dimension along a column than in a dimension along a row such that the edge-to-edge spacing along the column is less than the broadside-to-broadside. Accordingly, other techniques may be used to provide a comparable impedance for pairs formed of adjacent conductive element along a row and along a column. Those techniques may include placement of lossy material between adjacent conductive elements along a row, without a comparable amount of lossy material between adjacent elements along a column.

Alternatively or additionally, such techniques may include placing material of a higher dielectric constant between adjacent conductive elements along a row than between adjacent elements along a column. In some embodiments, a higher dielectric constant may be achieved by using a high dielectric constant material for an insulative housing of the connector. Slots, filled with air or other low dielectric constant material, may be introduced between conductive elements along the columns.

In some embodiments, the lossy material may be partially electrically conducting and may be positioned to contribute to equalizing impedance of pairs when there is unequal spacing between conductive elements in various directions. In such embodiments, the lossy material may be positioned selectively between conductive elements that have a wider separation.

To avoid increasing coupling between conductive elements that are not intended to form a differential pair, which when the conductive elements are used to carry signals, can lead to increased cross talk, the lossy material may be shaped to limit capacitive coupling through the lossy material. The inventors have recognized that such coupling may undesirably increase cross talk. Accordingly, techniques as applied herein may include incorporation of slots in a lossy member as a way to reduce capacitive coupling. The effect of slots may be achieved by providing multiple strips of lossy material.

While not intending to be bound by any theory of operation, the inventors theorize that characteristic impedances or impedance matrices may be associated with a group of substantially parallel-running ground conductor pins and the propagating modes of electrical fields they support, because, in use, such pins may be connected together to common ground reference conductors on printed circuit boards. However, one source of resonance having to do with electrical charge and current patterns on ground conductor pins in an open pin field connector involves propagating modes that are terminated in a short circuit or an unmatched zero impedance. As a result, ground conductor pins and common ground reference conductors may exhibit a tendency to store electromagnetic energy in the form of a resonant "cavity" or structure.

Resonant storage of energy in connectors discussed herein may involve standing waves that include superimposed backward and forward reflected electromagnetic modes which traverse the connector structure multiple times. In contrast, a preferred signal propagation may involve a one-time single-directional passage of a signal propagation mode. To achieve desired signal propagation, a connector may be constructed to incorporate electromagnetically lossy materials. Such lossy materials may be included in the connector such that the loss that the materials introduce into undesirable resonant modes is great enough to reduce deleterious effects on signal transmission, reflections, crosstalk, and the like, while keeping the effect on the loss of desired signal transmission to an acceptable level.

Though, in an open pin field connector, because it is not known in advance which conductive elements will be connected as ground conductors, compensation of resonance and other undesirable electrical effects may be applied to multiple conductive elements in the connector such that, regardless of which are connected as ground, resonance effects will be suppressed. Such compensation may be applied such that similarly positioned conductive elements and pairs of conductive elements receive similar compensation. Applying compensation in this fashion may lead to subassemblies with columns of conductive elements in which lossy members are symmetrically positioned with respect to each column.

Also, it may be desirable to compensate for crosstalk or other effects that can occur at high frequencies. By doing so, embodiments of open pin field connectors described herein can be adapted to operate at a high frequencies. Adapting a connector in this way may allow a newly designed high speed connector half to mechanically and electrically mate with a previously designed open pin field connector half. As a specific example, a daughter card connector may be adapted for high frequency operation using techniques as described herein. Such a high frequency connector will nonetheless be compatible with a conventional backplane connector. By attaching the high speed daughter card connector to newly designed high speed daughter cards that carry high speed chips, the high speed daughter cards can be inserted into an electronic device with a backplane using a conventional backplane connector, allowing the device to be upgraded or for new, high frequency devices to be manufactured without changes to the portions of the device that include the backplane.

As a specific example, an industry standard HM daughter card connector may be modified to provide high speed performance above 10 Gigabits per second, even when mated with a conventional HM backplane connector. Such a connector may have a rectangular array of conductive elements that are spaced 2 mm on center at the mating ends and/or at the contact tails where the connector is attached to a printed circuit board.

In various embodiments, application of lossy material is illustratively provided on a two-piece daughter card to a backplane multipin connector. In some embodiments, a connector may include a backplane mating half that includes an insulative housing and free-standing or insulatively supported backplane conductive contacts having opposite ends that are adapted for connection to respective traces within a circuit board. Embodiments as described herein may provide a daughter card connector that can mate with such a backplane connector, but that supports higher speed signals than a conventional HM connector. Such a connector can support higher speed signals without giving up the flexibility of an open pin field connector to use any conductive element for any purpose.

Any suitable construction technique may be used for such a daughter card connector. For example, the daughter card connector may be constructed for a plurality of subassemblies, such as wafer structures. Wafer structures may contain a plurality of daughter card conductive contacts, where each of the conductive contacts have opposite ends, one end of which is configured for mating to conductive elements in a backplane connector. A second end may be configured for connection to a printed circuit board. An intermediate portion may join these two ends. In some embodiments, the intermediate portion may bend through an angle of approximately 90 degrees to form a right angle connector.

In some embodiments, each wafer may include one or more lossy conductive members that are adjacent to, and in some embodiments surround, but do not make electrical contact with, the conductive contacts. For example, lossy material may surround conductive contacts in a right angle lead frame portion, yet not be in electrical or physical contact. Though, in other embodiments, lossy material may be in contact with conductive elements in an electrical assembly. In embodiments in which the lossy material adjacent each conductive element is electrically isolated from lossy material adjacent other conductive elements, the lossy material may make electrical or mechanical contact with the conductive elements. In other embodiments, the lossy material may be an insulator such that, even though the lossy material mechanically contacts conductive elements, no electrical connection is made through contact between the lossy material and the conductive elements.

Incorporation of the lossy material may give rise to an amount of loss that ranges between about 0 and 3 dB over an operating frequency range of interest, such as up to 5 GHz. Taking a 10 Gbit/sec data signal as an example, half the data rate will correspond to 5 GHz, which will lead to approximately 1 to 3 dB of loss in order to suitably mitigate undesirable resonance effects.

Regardless of the specific lossy material used, one approach to reducing the coupling between adjacent pairs is to include lossy material in each wafer between the intermediate portions of conductive elements that are part of separate pairs. Such an approach may reduce the amount of energy coupled to grounded pairs and therefore reduce the magnitude of any resonance induced.

In some embodiments, lossy insulator or insulated conductor materials may be used for improving overall connector data transmission performance. A connector may be described as a collection of transmission line conductors, partially or fully enclosed in a solid material where little to no series attenuation loss occurs at a DC frequency, yet having substantial intrinsic AC loss properties at baseband frequencies excluding DC, or a specific intended frequency range. Such a material may be referred to as an "AC lossy material." "AC lossy material" may serve as a "resonance damping material" or may be referred to simply as "lossy material."

In some embodiments, a connector may exhibit substantial, and beneficial, attenuation above DC, of data signal waveforms transmitted through the connector transmission line components. The use of AC lossy material may result in beneficial attenuation of a primary electromagnetic field configuration of the transmitted data signal. Such attenuation may result in a loss of some transmitted signal margin in a system. However, this signal degradation may be seen as desirable or beneficial to an interconnect system, and in certain cases, such signal degradation can be tolerated or compensated for by other interconnect system components. In particular, purposeful attenuation and degradation of the transmitted signal by some arrangement of AC lossy material is useful in helping to mitigate, or reduce, resonance and/or multi-conductor transmission line crosstalk coupling effects, intrinsic to connector conductor geometries.

In the case of resonance, the application of AC lossy material may mitigate and/or reduce the effects of distortion due to undesirable transmission line re-reflection or connector subcomponents behaving as resonator structures (e.g. transmission line stub). A beneficial result from the reduction of transmission line re-reflection in connectors is a subsequent further attenuation of crosstalk coupling resulting from connector resonance.

In the case of multi-conductor transmission line crosstalk coupling effects in the connector transverse cross-section, generically described as crosstalk occurring in a plane normal to the direction of propagation, AC lossy material may be designed to reduce inductive crosstalk with substantial magnetic loss properties, or reduce capacitive crosstalk with substantial material dipole and/or conduction eddy current loss.

In some aspects, the disclosure relates to an electronic device in which circuit assemblies, such as PCBs, are interconnected with open pin field connectors in which AC lossy material has been incorporated. The AC lossy material may be incorporated in connection with substantially all of the conductive elements in each column. Such a configuration may provide desirable electrical properties for carrying high speed signals through the connectors regardless of the pin assignments made. The connectors may be configured to provide edge coupling for a differential signal imposed on an adjacent pair of conductive elements in the same column. Alternatively, without changes to the design of the connectors, the connectors may be configured to provide broadside coupling for a differential signal imposed on a pair of adjacent conductive elements in adjacent columns. Such coupling may achieve desirable high frequency performance regardless of which pairs of conductors are selected.

The AC lossy material may be material in any suitable form, including any AC lossy material as described below. Such material may be partially conductive, magnetic or dielectric.

The AC lossy material may be incorporated into the connector in any one or more ways. In some embodiments, the AC lossy material is molded or placed around the conductive elements, though separated from the conductive elements by an insulator. Though, in some embodiments, the AC lossy material may directly contact the conductive elements. In embodiments in which the AC lossy material is electrically conductive, the regions of AC lossy material contacting a conductive element may be isolated from other conductive elements, or other regions of AC lossy material that contact other conductive elements, by insulating material. In embodiments in which the AC lossy material is a dielectric, contiguous regions of AC lossy material may contact multiple conductive elements, including multiple adjacent conductive elements in the same row or column.

In some embodiments, the amount of AC lossy material in contact with each conductive element, which may be controlled by controlling the length of the conductive element adjacent to or in contact with the AC lossy material, may provide a loss along each conductive element of between 1 dB and 3 dB. Though, in some embodiments, the loss may be between about 0.7 dB and about 3 dB. In yet other embodiments, the loss may be between about 1 dB and about 4 dB. This loss may be achieved at a frequency (in Hertz) that corresponds to one half the data rate of signals to pass through the connector. As a specific example, a connector may be designed for high frequency performance on the order of 10 GigaBits per second and may have a loss between 1 dB and 3 dB at 5 GHz.

Turning to the figures, FIG. 1 illustrates a portion of an electronic system that includes daughter card 200 and backplane 520. It should be appreciated that the simplified illustration of FIG. 1 shows only portions of these components, and one of skill in the art that additional components will be included in the electronic system.

The system includes an electrical connector 100 providing a plurality of conducting paths between traces in backplane 520 and traces in daughter card 200. Here connector 100 is a right angle, open pin field connector that has a mechanical form factor according to a standard, such as the HM standard. In accordance with that standard, connector 100 provides a plurality of conducting paths that are arranged in a regular array with an on-center spacing between the conductive elements of 2 mm. Though it should be appreciated that any suitable spacing may be used. The spacing may range, for example, between 1.5 mm and 3 mm.

Connector 100 is illustrated as comprising two parts, a daughter card connector 102 and a backplane connector 500. In this example, daughter card connector 102 is assembled form a plurality of subassemblies, here shown as a plurality of wafers 300. The plurality of wafers 300 are attached to an insulative front housing 400. In the illustrated embodiment, each wafer contains a column of conductive elements, each of which has a mating contact portion. In the embodiment illustrated, the mating contact portions are inserted into front housing 400. The conductive elements also include contact tails (not numbered) that make electrical connections to daughter card 200. Though not visible in FIG. 1, each of the conductive elements has an intermediate portion joining the contact tail and the mating contact portion that passes through the wafer.

Though, it can be appreciated that any suitable construction techniques may be used to form daughter card connector 102, in addition to or as an alternative to the wafers.

Backplane connector 500 includes backplane conductors 510 that can be mated with conductive elements of the plurality of wafers 300 through openings 410 of the insulative housing 400. Backplane conductors 510 also have contact tails connected to backplane 520. As a result, when the daughter card connector 102 and backplane connector 500 are suitably mated to one another, an electrical connection is established between the daughter card 200 and backplane 520 through the conductive elements within connector 100.

In the embodiment illustrated, connector 100 is an open pin field connector. Accordingly, the function of each conductive element in the connector is determined by the connections to the printed circuit boards. Such connections are specified by a designer of the electronic system when connections between conducting structures within the daughter card or backplane are assigned.

Though the connector 100 has a pattern of contact tails extending from daughter card connector 102 and backplane connector 500 and/or a pattern of mating contact portions at the mating interface between daughter card connector 102 and backplane connector 500 that conforms to a standard, either or both of daughter card connector 102 or backplane connector 500 may be constructed to operate at a higher frequency than a conventional connector. Such improved high frequency performance may be achieved regardless of how the assignments between conductive structures in the printed circuit boards and the conductive elements in the connectors are made when designing the electronic system. In the illustrated embodiment, backplane connector 500 is a conventional HM connector. however, daughter card connector has been configured, using techniques as described herein, to operate at higher frequencies.

In some embodiments, a wafer containing a signal lead frame, a front housing, and/or a backplane housing may be constructed with a lossy material. This material may be positioned to provide improved high frequency performance.

Figure 2:
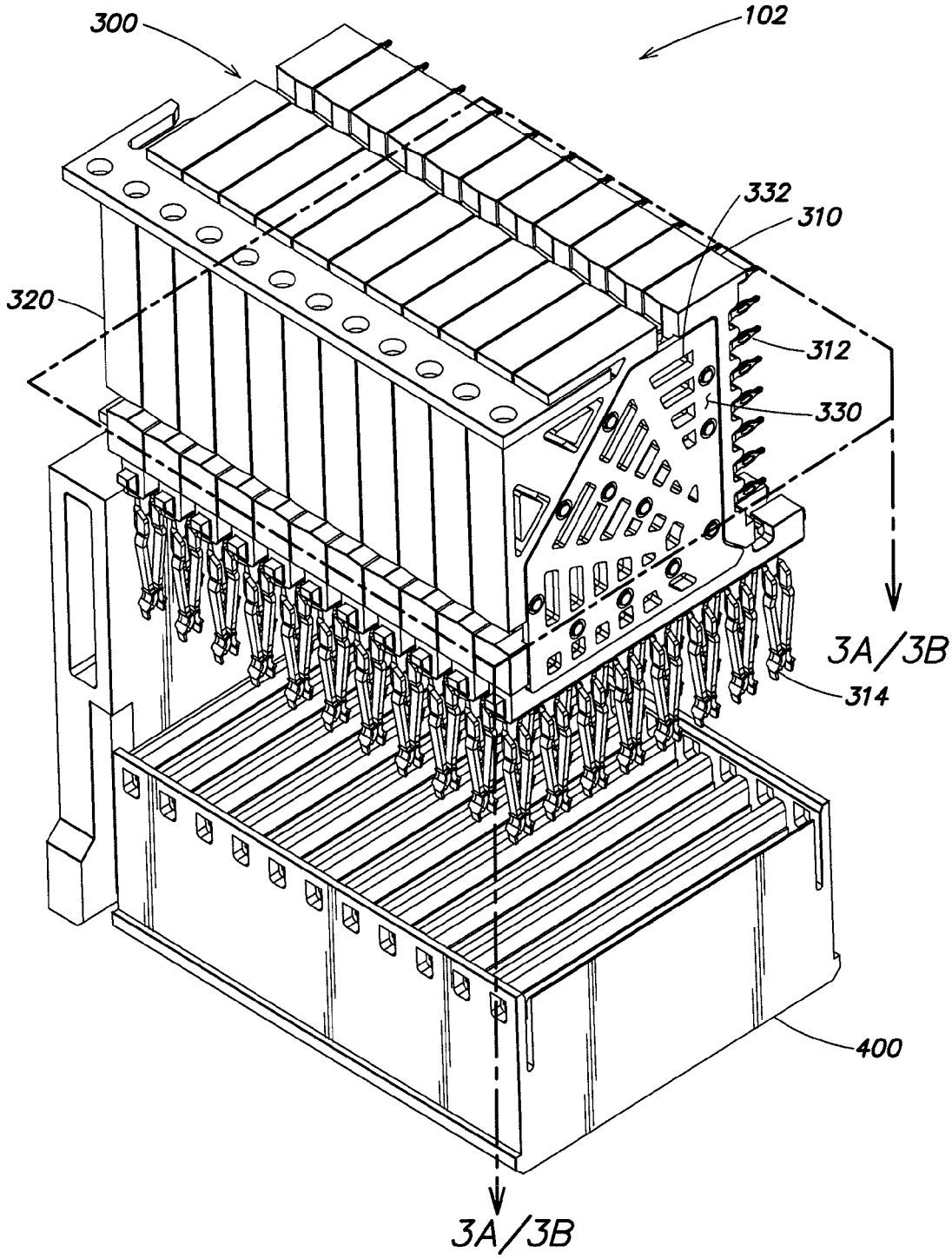
FIG. 2 is another perspective, partially exploded view of a connector within an electrical interconnection system in accordance with some embodiments.
Figure 4:
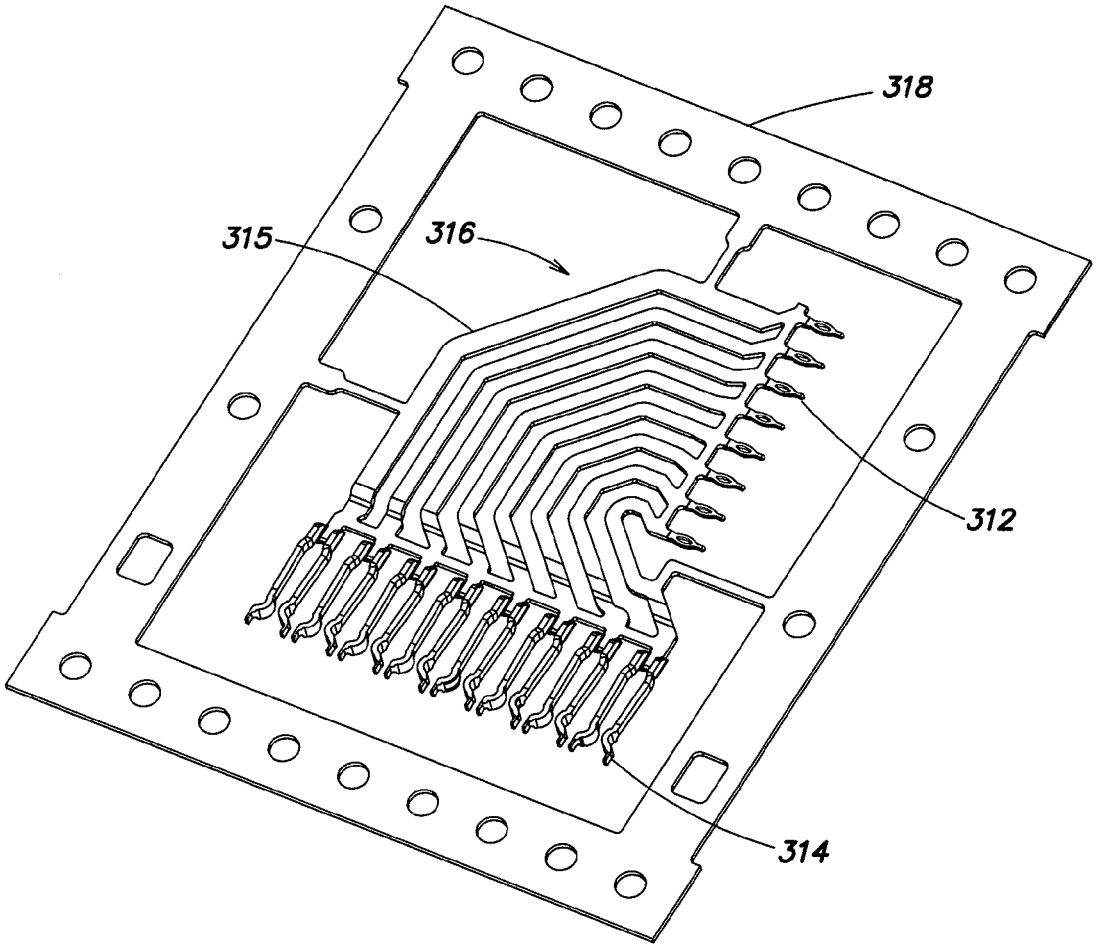
FIG. 4 is a perspective view of a conductive element lead frame prior to incorporation of the conductive elements within an insulative material.

FIG. 2 depicts a closer view of the daughter card connector 102. A conductive wafer 310 includes a contact tail 312 which, for example, is suited to connect to a connection portion of a daughter card 200. The wafer 310 also includes mating contact portions 314 that may be suitable for mating with connection portions of a backplane connector 500. Contact tails 312 and mating contact portions 314 may be included in conductive elements 316 of a wafer 310 where an electrical pathway is provided between corresponding contact tails 312 and mating contact portions 314 through an intermediate portion 315 (FIG. 4). In the embodiment illustrated, wafer 310 includes an insulative material portion 320 and a lossy material portion 330. Lossy material portion 330 may be formed from a lossy material.

Electrically lossy material can be formed from material traditionally regarded as dielectric materials, such as those that have an electric loss tangent greater than approximately 0.003 in the frequency range of interest. The "electric loss tangent" is the ratio of the imaginary part to the real part of the complex electrical permittivity of the material. Electrically lossy materials can also be formed from materials that are generally thought of as conductors, but are either relatively poor conductors over the frequency range of interest, and may contain particles or regions that are sufficiently dispersed that they do not provide high conductivity or otherwise are prepared with properties that lead to a relatively weak bulk conductivity over the frequency range of interest. Electrically lossy materials typically have a conductivity of about 1 siemens/meter to about $6.1\times10^7$ siemens/meter, preferably about 1 siemens/meter to about $1\times10^7$ siemens/meter and most preferably about 1 siemens/meter to about 30,000 siemens/meter. In some embodiments, material with a bulk conductivity of between about 25 siemens/meter and about 500 siemens/meter may be used. As a specific example, material with a conductivity of about 50 siemens/meter may be used.

Electrically lossy materials may be partially conductive materials, such as those that have a surface resistivity between 1 Ω/square and $10^6$ Ω/square. In some embodiments, the electrically lossy material has a surface resistivity between 1 Ω/square and $10^3$ Ω/square. In some embodiments, the electrically lossy material has a surface resistivity between 10 Ω/square and 100 Ω/square. As a specific example, the material may have a surface resistivity of between about 20 Ω/square and 40 Ω/square.

In some embodiments, electrically lossy material is formed by adding to a binder a filler that contains conductive particles. Examples of conductive particles that may be used as a filler to form an electrically lossy material include carbon or graphite formed as fibers, flakes or other particles. Metal in the form of powder, flakes, fibers or other particles may also be used to provide suitable electrically lossy properties. Alternatively, combinations of fillers may be used. For example, metal plated carbon particles may be used. Silver and nickel are suitable metal plating for fibers. Coated particles may be used alone or in combination with other fillers, such as carbon flakes.

The binder or matrix may be any material that will set, cure or can otherwise be used to position the filler material. In some embodiments, the binder may be a thermoplastic material such as is traditionally used in the manufacture of electrical connectors to facilitate the molding of the electrically lossy material into the desired shapes and locations as part of the manufacture of the electrical connector. Examples of such materials include LCP and nylon. However, many alternative forms of binder materials may be used. Curable materials, such as epoxies, can serve as a binder. Alternatively, materials such as thermosetting resins or adhesives may be used. Also, while the above described binder materials may be used to create an electrically lossy material by forming a binder around conducting particle fillers, the invention is not so limited. For example, conducting particles may be impregnated into a formed matrix material or may be coated onto a formed matrix material, such as by applying a conductive coating to a plastic housing. As used herein, the term "binder" encompasses a material that encapsulates a filler, is impregnated with a filler or otherwise serves as a substrate to hold a filler.

Preferably, fillers may be present in a sufficient volume percentage to allow conducting paths to be created from particle to particle. For example, when metal fiber is used, the fiber may be present in about 3% to 40% by volume. The amount of filler may impact the conducting properties of the material.

Filled materials may be purchased commercially, such as materials sold under the trade name CELESTRAN® by Ticona. A lossy material, such as lossy conductive carbon filled adhesive preform, such as those sold by Techfilm of Billerica, Mass., U.S. may also be used. This preform can include an epoxy binder filled with carbon particles. The binder surrounds carbon particles, which acts as a reinforcement for the preform. Such a preform may be inserted in a wafer to form all or part of the housing. In some embodiments, the preform may adhere through the adhesive in the preform, which may be cured in a heat treating process. Various forms of reinforcing fiber, in woven or non-woven form, coated or non-coated may be used. Non-woven carbon fiber is one suitable material. Other suitable materials, such as custom blends as sold by RTP Company, can be employed, as the present invention is not limited in this respect.

In some embodiments, the lossy material may be insulative. Such lossy materials may be formed from an injection moldable polymer material having a dispersed filler of electromagnetically lossy ferrite particles. In some cases, the lossy material may be insulative enough such that contact of the lossy material and conductive contacts may occur.

In some embodiments, such a lossy material may behave in the 1 to 10 GHz range as a lossy dielectric material. For example, the lossy material may exhibit an effective dielectric constant that ranges between about 1 and about 20, or between about 4 and about 20. In some cases, the lossy material may exhibit a loss tangent in the range of between about 0.01 and about 0.2. In an embodiment, the loss tangent may depend upon the type and amount of ferrite particle filler material that is incorporated into the polymer matrix. The lossy material may be formed by injection molding. In some embodiments, if the lossy material behaves as an insulator, it may be molded directly over the conductive contacts, for example, through use of an insert molding process.

In a further aspect, portions of the conductive contacts in the lead frame or other regions may be either partially or completely covered by a lossy conductive material. In some embodiments, lossy conductive polymer compounds utilize a carbon particle filler having a conductivity that ranges between about 1 and about 100 Siemens/meter, as measured in the range of 1 to 10 GHz. In an embodiment, the lossy conductive material is electrically connected to the conductive contacts by direct physical contact.

In addition to lossy material, other materials may be incorporated into daughter card connector 102 to provide desirable electrical properties. In the embodiment illustrated, air gaps 322, 332 may be included within the insulative material portion 320 and the lossy material portion 330, respectively. Such air gaps 322, 332 may be located as slots between conductive elements 316 and may provide a lower dielectric constant material between conductive elements 316 that is different from that of the insulative material portion 320.

In the embodiment, illustrated, gaps 322 and 332 are aligned. These gaps may serve different, though beneficial purposes, such that the different types of gaps may be used together or only one type of gap may be used. Though, it is not a requirement that either type of gap be present in all embodiments of a connector with improved high frequency performance. In the illustrated embodiment, gaps 322 contribute to equalizing impedance among arbitrary pairs within the connector. Gaps 332 contribute to reducing cross talk.

In some embodiments, the backplane connector 500 also may include a lossy material (e.g., resonance damping material) in accordance with embodiments described herein. For example, lossy material may replace portions of a conventional backplane connector 500 and/or be applied on to regions of a backplane connector 500. However, in the illustrated embodiment, connector 102 is intended to operate with a conventional backplane connector such that high performance components, using a connector 102 may be plugged into an existing electronic chassis using a backplane connector 500. For this reason, connector 102 may be designed as an open pin field connector, meaning that any conductive element in the connector may be used for any function, such as to carry a high speed data signal, be part of a pair carrying a differential signal, carry a low speed signal or be connected to power or ground.

In exemplary open pin field connectors described herein, conductors are similar in overall shape, though the conductors, sometimes called conductive elements, may have different lengths in some connector configurations. Such similarity of conductors allows for flexibility in designating which conductors will be connected in a circuit assembly as ground conductors and which conductor ends will be connected as signal conductors, for example, upon connection between circuit boards. For example, circuit boards that the conductive elements are connected to may designate which conductive elements are to be signal conductors and which conductive elements are to be ground conductors. Similarly, conductive elements may be appropriately paired according to their connection with one or more suitable circuit boards. Upon inspection of an open pin field connector, it is not immediately apparent which conductors are assigned to ground or signal. Thus, it is possible for ground and/or signal pairs to be arranged in either a horizontal (along a row) or vertical (along a column) configuration.

In some embodiments, an open pin field connector is described into which AC lossy material has been incorporated in the lead frame. The open pin field connector comprises a plurality of columns of conductive elements, each column having an equal number of rows of conductive elements. The AC lossy material may be placed adjacent a plurality of consecutive conductive elements along each of the columns.

In some embodiments, AC lossy material may be placed adjacent at least three consecutive conductive elements along each of the columns, which may contain 5 or 8 conductive elements. Though, in some embodiments, AC lossy material may be located adjacent to substantially all of the conductive elements in each column. In some embodiments, such as a right angle connector in which the end rows of each column are short, AC lossy material may be omitted from adjacent these rows. As a specific example, AC lossy material may be placed adjacent 7 conductive elements in each column of a connector having 8 rows per column. Alternatively, the amount of AC lossy material adjacent to particular rows of each column may be adjusted, for example, to have a stepped profile as will be discussed in more detail below to provide a grater rate or loss adjacent the shorter rows.

Figure 3A:
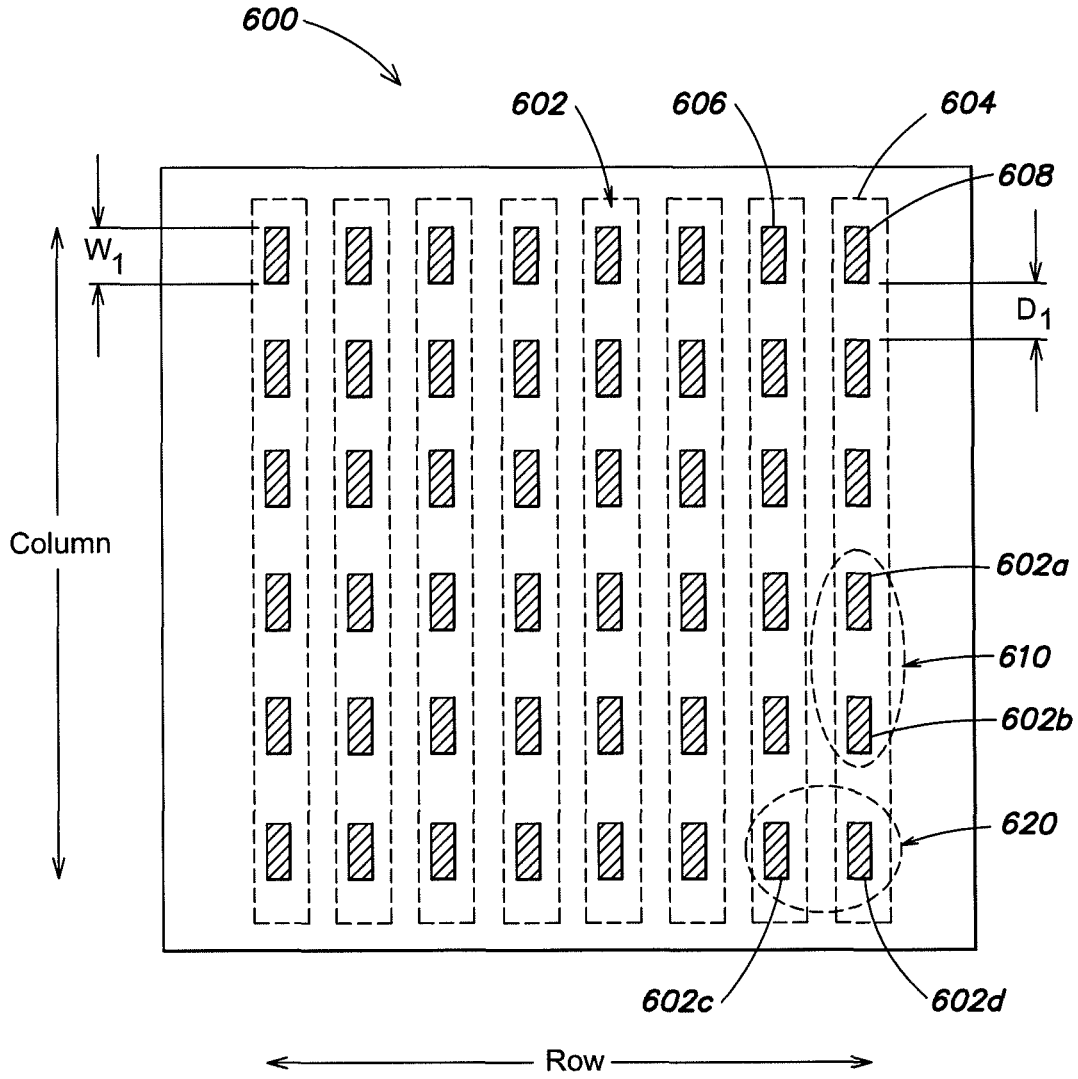
FIG. 3A is a schematic view of a cross-section taken through the plane labeled 3A/3B of the electrical interconnection system of FIG. 2 in accordance with some embodiments.
Figure 3B:
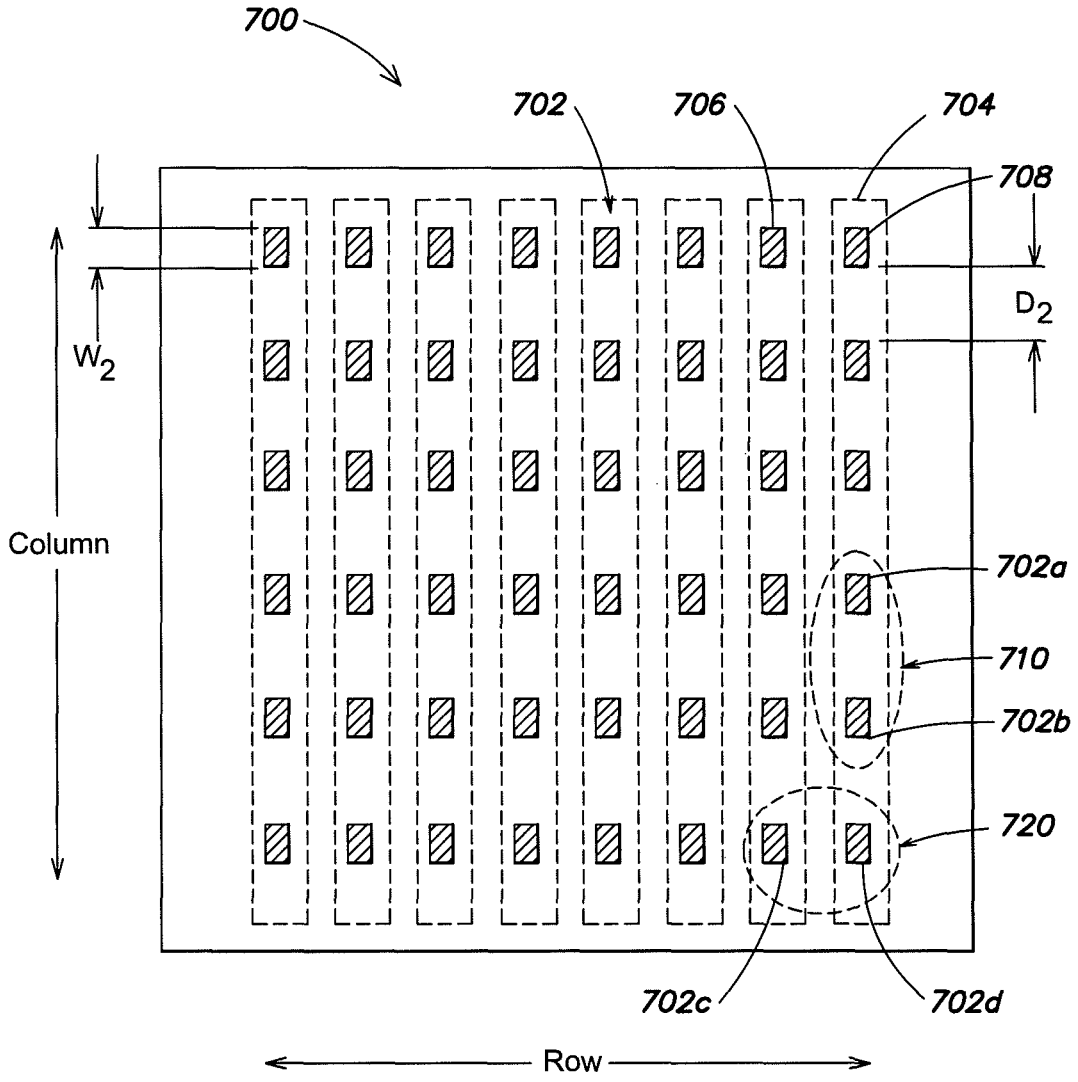
FIG. 3B is another schematic view of a cross-section taken through the plane labeled 3A/3B of the electrical interconnection system of FIG. 2 in accordance with other embodiments.

FIGS. 3A and 3B depict cross-sectional schematics 600, 700 as taken through the electrical connector of FIG. 2, illustrating various aspects of an open pin field connector. FIGS. 3A and 3B illustrate in cross section intermediate portions of the conductive elements in connector 102. In the embodiments described herein, the mating contact portions and the contact tails of the conductive elements are shaped and configured in a predetermined pattern. That pattern, for example, may comply with the HM standard such that the connector, though adapted for high frequency performance, may nonetheless mate with a standard backplane connector and may nonetheless be mounted on a daughter board designed for a standard HM connector. Accordingly, the techniques described herein are incorporated into the intermediate portion of the daughter card connector 102. However, other embodiments need not be limited in this way, and techniques as described herein may be incorporated into any suitable portion of a connector.

As shown, the conductive elements, in cross section, are disposed in a plurality of columns, each with a plurality of conductive elements, thereby forming a plurality of rows. Though the on center spacing of the conductive elements is the same in the row direction and the column direction, the conductive elements are not square in cross section. As a result, the separate between the conductive elements is not the same in the row direction and the column direction. As a result, the impedance of a pair of adjacent conductive elements, if selected along a row is different than if selected along a column, which may be undesirable in an open pin field connector in which any pair may be selected to carry a high speed differential signal.

In addition, FIGS. 3A and 3B reveal that the cross section of all of the conductive elements is uniform, meaning that none is specifically configured to act as a ground. Grounding certain pairs of conductive elements may therefore give rise to resonances, which in turn may create cross talk, increase insertion loss or create other negative effects. Selective incorporation of lossy material may contribute to ameliorating both differences in impedance among different pairs and problems associated with resonances.

Although not shown in FIGS. 3A and 3B, lossy material may be incorporated in the open pin field connector adjacent to conductive elements, for example, so that resonance effects may be dampened. In some embodiments, lossy material is located in between conductive elements. As a specific example, the lossy material may be positioned between columns, as defined in FIGS. 3A and 3B, such that the lossy material is between conductive elements that have a wider separation. As described further below, depending on the nature of the conductive elements (e.g., shorter or longer conductive elements), the amount and location of lossy material may be appropriately varied. For example, lossy material may be provided in the open pin field connector in a manner that gives rise to arbitrarily designated conductive pairs having similar impedance for high frequency signals.

In some embodiments, conductive elements provide differential signal conducting paths having a nominal impedance with signal paths formed from adjacent conductive elements in the same column with an impedance of no less than 80% of the nominal impedance. Alternatively, in some embodiments, signal paths formed from adjacent conductive elements in adjacent columns exhibit an impedance no greater than 120% of the nominal impedance. For a nominal design of 100 Ohms for any pair, techniques as described herein may provide an impedance of 85 Ohms or higher for pairs of adjacent conductive elements in the same column while providing 120 Ohms or lower for pairs of adjacent conductive elements in the same row. Though, other embodiments may provide an impedance of 90 Ohms or higher for pairs of adjacent conductive elements in the same column while providing 115 Ohms or lower for pairs of adjacent conductive elements in the same row. As yet another example, other embodiments may provide an impedance of 95 Ohms or higher for pairs of adjacent conductive elements in the same column while providing 115 Ohms or lower for pairs of adjacent conductive elements in the same row. For other nominal impedances, such as 85 Ohms, similar tolerances, as a percentage of the nominal impedance, may be achieved.

In FIG. 3A, the cross-sectional schematic 600 includes a plurality of conductive elements 602 organized into columns and rows. In some embodiments, the plane of a wafer 310 is disposed along a column where conductive elements of a single wafer are positioned parallel to the column direction. Dotted lines illustrated represent the orientation of a plane of a wafer 604 with respect to the conductive elements 602. Accordingly, conductive elements disposed along a row may belong to separate wafers stacked in parallel, oriented perpendicular to the plane of a wafer 604.

In various embodiments, conductive elements 602 are arranged indiscriminately with respect to which conductive elements will be grouped into differential pairs, in what direction the pairs will be oriented, and whether the conductive elements function as signal conductors or ground conductors. As shown, conductive elements 602*a*, 602*b* are designated as one conductive pair 610 disposed along a column in an edge-to-edge configuration and located within the same conductive wafer. Conductive elements 602*c*, 602*d* are designated as another conductive pair 620 disposed along a row configured in a broadside-to-broadside configuration and are located within different conductive wafers.

FIG. 3A may represent a connector formed using a conventional lead frame. In some embodiments in which the on center spacing is 2 mm, the edge-to-edge distance $D_1$ between conductive elements may range between about 0.2 mm and about 0.4 mm. In some embodiments, the broadside-to-broadside distance between conductive elements may range between about 1.5 and about 1.8 mm. In some embodiments, the width $W_1$ of conductive elements may range between about 1.6 and about 1.8. These spacings result in closer coupling between conductive elements in the same column than in the same row. Consequently, electrical performance may be different for pairs of adjacent elements in the same column than in the same row.

FIG. 3B illustrates a cross-sectional schematic 700 that is similar to the schematic 600 except that the conductive elements 702 are narrower, giving rise to an increased edge-to-edge distance between conductive elements 702. As a result, spacings between adjacent conductive elements in the same row more closely approximate the spacings between conductive elements in the same column. In some embodiments, the edge-to-edge distance $D_2$ between edges of conductive elements 702 disposed along a column is greater than 5%, greater than 10%, or greater than 20% that of the edge-to-edge distance $D_1$ between edges of conductive elements 602 disposed along a column. In some embodiments, increasing the distance between edges of conductive elements may generally lower the overall impedance of the conductive pair. In some embodiments, the edge-to-edge distance $D_2$ between conductive elements may be any value in the range between about 0.4 mm and about 0.8 mm. In some embodiments, the broadside-to-broadside distance between conductive elements may be any value in the range between about 1.5 and about 1.8. In some embodiments, the width $W_2$ of conductive elements may be any value in the range between about 1 mm and about 1.5. For example, the width $W_2$ of the conductive elements of FIG. 3A may be between about 20% and about 50% less than the width $W_1$ of conductive elements of FIG. 3B. Similar to FIG. 3A, the dotted lines of FIG. 3B represent the orientation of a plane of a conductive wafer 704 with respect to the conductive elements 702. In embodiments in which other on center spacings are used, such as 1.8 mm, the distances and widths may have a similar proportion of the on center spacing.

As any two adjacent conductive elements may be designated as a conductive pair having a certain function (e.g., as signal or ground conductors), the impedance of conductive pairs disposed edge-to-edge along a column may be similar in value to the impedance of conductive pairs disposed broadside-to-broadside along a row. In some cases, the difference in impedance between an arbitrarily chosen conductive pair disposed edge-to-edge along a column compared with an arbitrarily chosen conductive pair disposed broadside-to-broadside along a row may be less than about 30%, less than about 20%, or less than about 10%. For example, the nominal impedance of a conductive pair such as group 710, disposed edge-to-edge along a column, and the nominal impedance of a conductive pair such as group 720, disposed broadside-to-broadside along a row may both be approximately 85 ohms +/− a tolerance of 30%, 20% or 10%. Similar tolerances may be achieved for a nominal impedance of 100 ohms.

In embodiments of an open pin field connector, an array of conductive elements that are not pre-designated by structure such as size and/or shape to serve certain purposes, for example, to function as signal conductors or ground conductors. In some embodiments, a reduction in resonance may accommodate a range of desired uses for the conductive elements.

Any two adjacent conductive elements may be configured to carry a high speed differential signal. In some embodiments, similar to conductive pairs 610, 710, adjacent conductive elements may be selected in the same column to act as a differential pair, resulting in edge coupling. In some embodiments, similar to conductive pairs 620, 720, conductive elements from the same row and adjacent columns may be selected to function as a differential pair, resulting in broadside coupling.

Any suitable construction techniques may be used to form such connectors. An exemplary construction technique is described in connection with FIGS. 4-9.

FIG. 4 illustrates a lead frame for forming a right angle wafer. The lead frame includes contact tails 312 for attaching to a daughter card and mating contact portions 314 for mating with a backplane connector. FIG. 4 depicts conductive element 316 that provide an electrical pathway between contact tails 312 and mating contact portions 314, prior to incorporation of insulative or lossy materials thereon. This lead frame may be stamped from a sheet of metal, such that the thickness of the conductive elements is dictated by the thickness of the stock.

In the embodiment shown, conductive elements 316 are attached to an outer frame 318 via attachment regions 319*a*, 319*b*, 319*c*. This configuration represents an intermediate stage of manufacture of the connector in which the conductive elements 316 are held by temporary attachment regions attachment regions 319*a*, 319*b*, 319*c* for ease of handling. At a subsequent stage, attachment regions 319*a*, 319*b*, 319*c* may be severed.

Though the lengths of the conductive elements are different because of the right angle configuration, the cross sections of all of the conductive elements are the same. In the example illustrated, the lead frame includes eight conductive elements 316. For example, each conductive element 316 may have a width of about 0.8 mm and a thickness of about 0.2 mm. However, conductive elements of any suitable configuration may be used.

In a subsequent stage of manufacturing, insulative material may be over molded on the lead frame to form a wafer. In some embodiments, the over molded portions may contain multiple types of material, some of which may be lossy. However, in the embodiment illustrated, the material that is over molded functions as an insulator and lossy members are separately formed and attached, when desired.

Figure 5A:
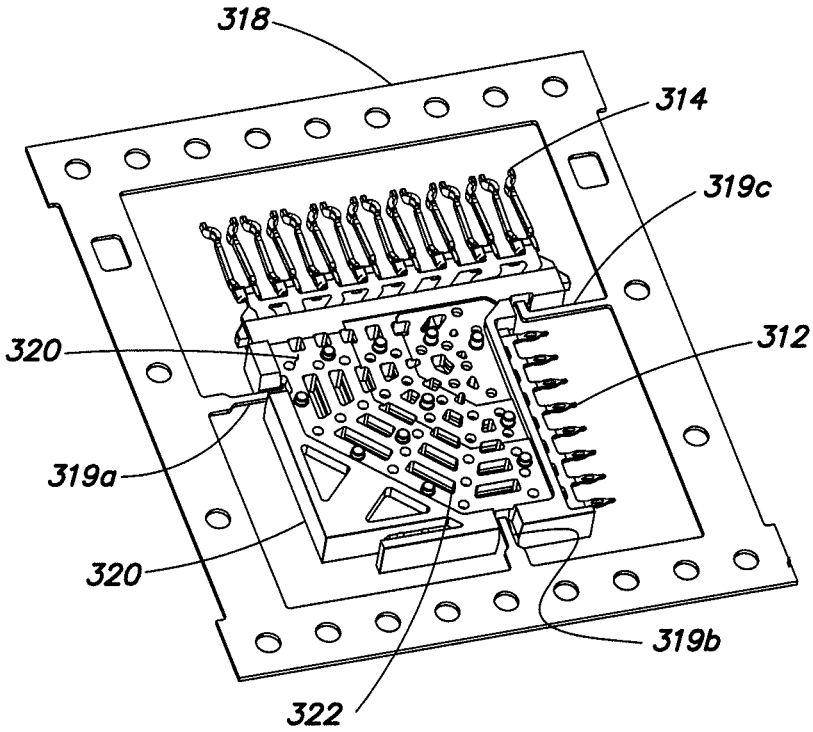
FIG. 5A is a perspective view of a conductive element lead frame having incorporated an insulative material thereon in accordance with other embodiments.
Figure 5B:
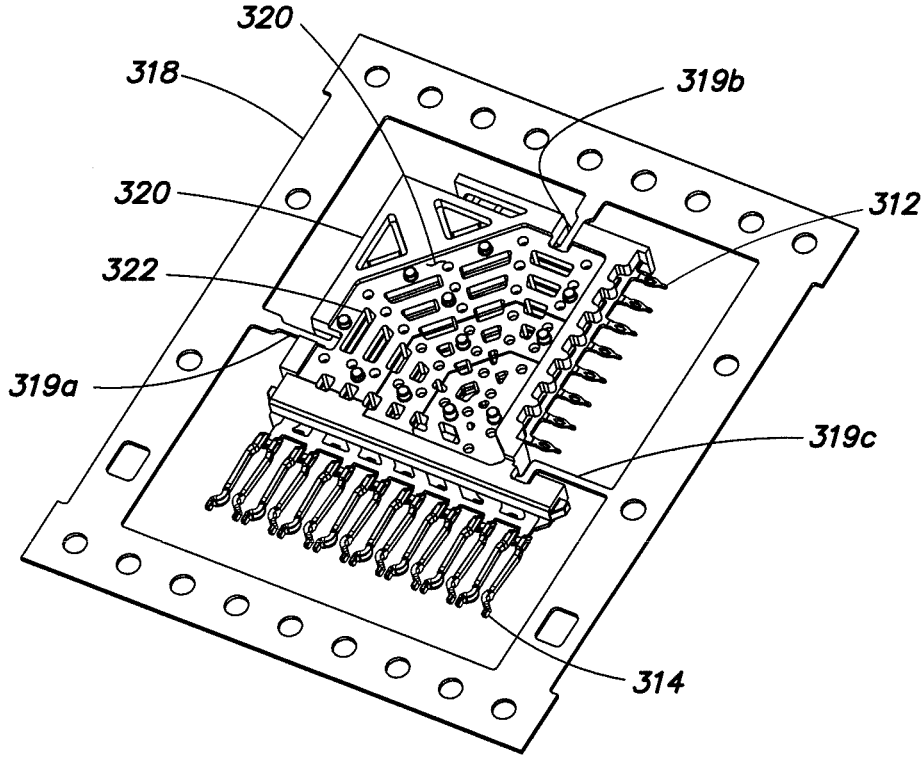
FIG. 5B is another perspective view of a conductive element lead frame having incorporated an insulative housing thereon.

An insulative material having been over molded on to the lead frame of FIG. 4 is shown in FIGS. 5A and 5B. To achieve this configuration, conductive elements 316 are held by outer frame 318 and are placed in an appropriate mold for injection molding of insulative material around the conductive elements 316. Accordingly, the insulative material portion 320 is formed around the conductive elements 316 so as to hold the conductive elements in place. As illustrated, for some embodiments, air gaps 322 may be formed in the insulative material portion 320, providing for regions of material of lower dielectric constant located adjacent to conductive elements 316.

In the illustrated embodiment, those lower dielectric constant regions may be filled with air, such that the relative dielectric constant in those regions is closer to 1. In contrast, conventional insulative material used in forming electrical connectors has a relative dielectric constant of approximately 2.8. In some embodiments, the insulative material will be a high dielectric constant material, having a relative dielectric constant above 2.8. The relative dielectric constant, or example, may be above 2.9 or 3.0 or above. In some embodiments, the high dielectric constant material will have a relative dielectric constant above 3.0 and below 3.5.

The dielectric contact of the material may be controlled in any suitable way. For example, the insulative material may be formed with an LCP binder and fillers. The amount and nature of the fillers may be selected to provide a desired dielectric constant. Alternatively or additionally, the nature of the binder may be selected to provide a desired dielectric constant.

Any suitable construction techniques may be used to appropriately position the lossy material within the connector. Also, any suitable amount of lossy material may be used. In some embodiments, the amount of lossy material, and the loss properties of that material, may be selected to, in aggregate provide a suitable level of resonance suppression with an acceptable level of insertion loss. In some embodiments, the insertion loss, for any pair of adjacent conductive elements, may be less than 6 dB at frequencies up to 10 GHz. The insertion loss may be less than 3 dB at 5 GHz.

In some embodiments, such a lossy portion may be formed by a second-shot over molding of a lead frame which has first been insert molded with a non-conductive polymer. In some embodiments, a lossy conductive member may be constructed of injection moldable polymer with carbon particle filler. The non-conductive polymer may provide an insulating layer on each conductive contact.

However, in the embodiment illustrated, one or more lossy inserts may be formed separately and then attached to the insulative portions of a wafer. In such an embodiment, an outer surface of the insulative portions of the wafer may be shaped to receive the lossy insert. The wafer may also include attachment features that engage complementary attachment features on the lossy insert to hold the two together. In some embodiments, for example, lossy material may be introduced into an electrical connector using two clamshell halves that are attached to two opposing sides of the lead frame. In some embodiments, the two sides of the lead frame may first have been insert molded with non-conductive polymer so as to provide slots for inwardly projecting ribs on at least one of the clamshell halves to pass between adjacent conductors of the lead frame. However, in the embodiment illustrated in FIGS. 5A and 5B, the lossy material is selectively positioned to run parallel to the column of conductive elements in a wafer, without extending into the wafer between the conductive elements.

Figure 6A:
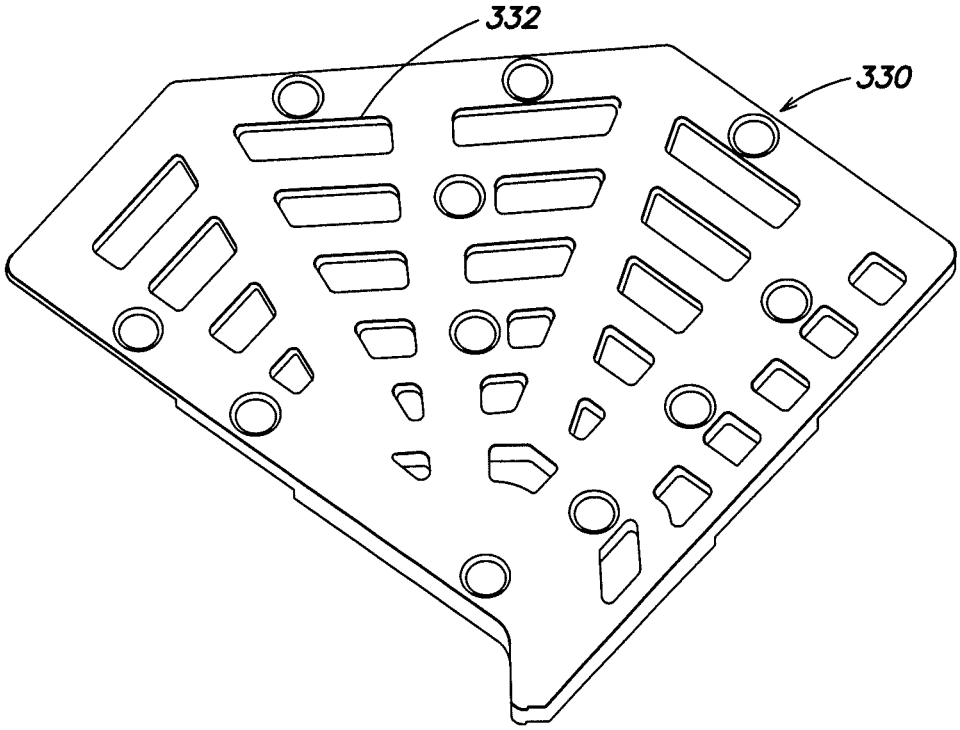
FIG. 6A is a perspective view of a planar member of lossy material.
Figure 6B:
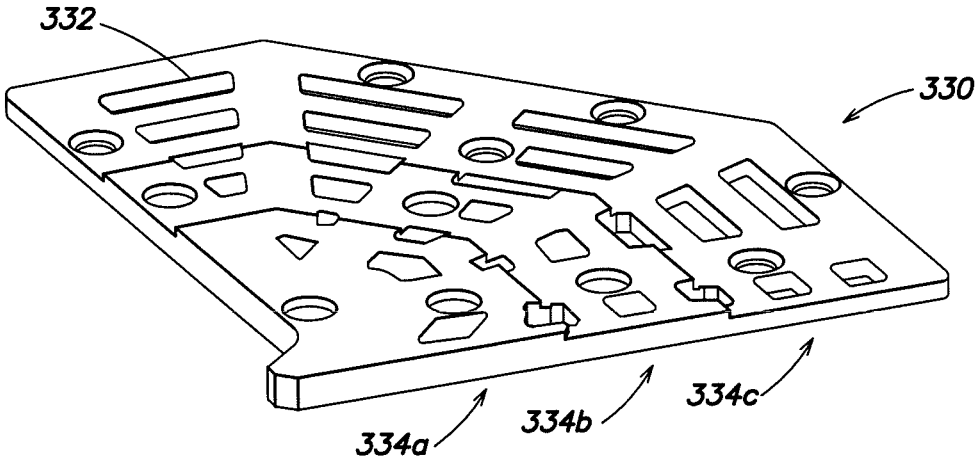
FIG. 6B is another perspective view of a planar member of lossy material.

In some embodiments, once the insulative material portion 320 is formed around the conductive elements 316, lossy material portions 330 may be formed around the insulative material portion 320. FIGS. 6A and 6B depict a lossy material portion 330 formed as a planar member and having air gaps 332 incorporated within the planar member. These air gaps create what are effectively strips that follow the contours of the conductive elements, as illustrated in FIG. 4. These strips are joined by members to create a unitary structure that. Such a unitary structure may facilitate forming of the lossy insert using a molding operation, for example. The joining members also facilitate handling of the members that provide lossy material adjacent conductive elements. Also, though not wishing to be bound by any particular theory of operation, the joining members between the strips may also improve electrical performance. Though, as revealed by other embodiments below, it is not a requirement that the strips be part of a unitary member.

Using strips of lossy material, even if held together by joining members, may facilitate achieving an appropriate balance of electrical properties. In this example, the slots that separate the strips reduce the capacitive coupling between conductive elements in adjacent columns of a connector. With the incorporation of such slots, both the power sum and far end cross talk, as measured using known techniques may be below −20 dB over frequencies up to 10 GHz and, for example, may be below −25 dB at 5 GHz.

The lossy properties of a lossy conductive material may be appropriately adjusted by changing its thickness, spacing relative to a conductive element and other dimensions, and/or by changing its bulk conductivity. For example, lossy materials described may exhibit conductivity over the range of about 1 Siemen/meter to about 100 Siemens/meter, as measured in the range of 1 to 10 GHz. The lossy material portion 330 may also be configured in a stepped profile where regions 334*a*, 334*b*, 334*c* are of varying thicknesses.

A further technique that may be employed to control the electrical properties of conductors in an electrical connector may be to configure the lossy conductive material such that the rate of loss along the various conductive elements in the connector is different for different ones of the conductive elements. In a right angle connector, for example, some rows of conductive elements are shorter than others. The electrical pathway may be longer for a conductive element having a larger average radius, and similarly, the electrical pathway may be shorter for a conductive element having a smaller average radius. The lossy material may be configured such that the rate of loss introduced by the lossy material varies inversely in relation to the length of the conductive elements. In this way, each of the conductive elements may experience comparable loss, despite differences in length. Accordingly, so that the performance/attenuation of neighboring conductive elements is generally similar, it may be advantageous to adjust the amount of lossy material and/or the distance of the lossy material from an adjacent conductive element.

For example, in certain wafers, more lossy material may be incorporated adjacent to conductive elements that define shorter electrical pathways as compared with conductive elements defining longer electrical pathways. When more lossy material is disposed around a conductive element, the loss/unit length generally increases. Alternatively, or in addition, lossy material may be positioned closer to adjacent conductive elements defining shorter electrical pathways as compared with conductive elements that define longer electrical pathways. When lossy material is located in close proximity to a conductive element, an increase in loss/unit length generally arises. Accordingly, the electrical connectors may be designed so that the amount of attenuation along each conductive element is approximately the same. Such an adjustment may be beneficial for cases where conductive elements are not pre-designated to function as signal or ground conductor and, also, where conductive pairs are not predetermined.

Figure 6C:
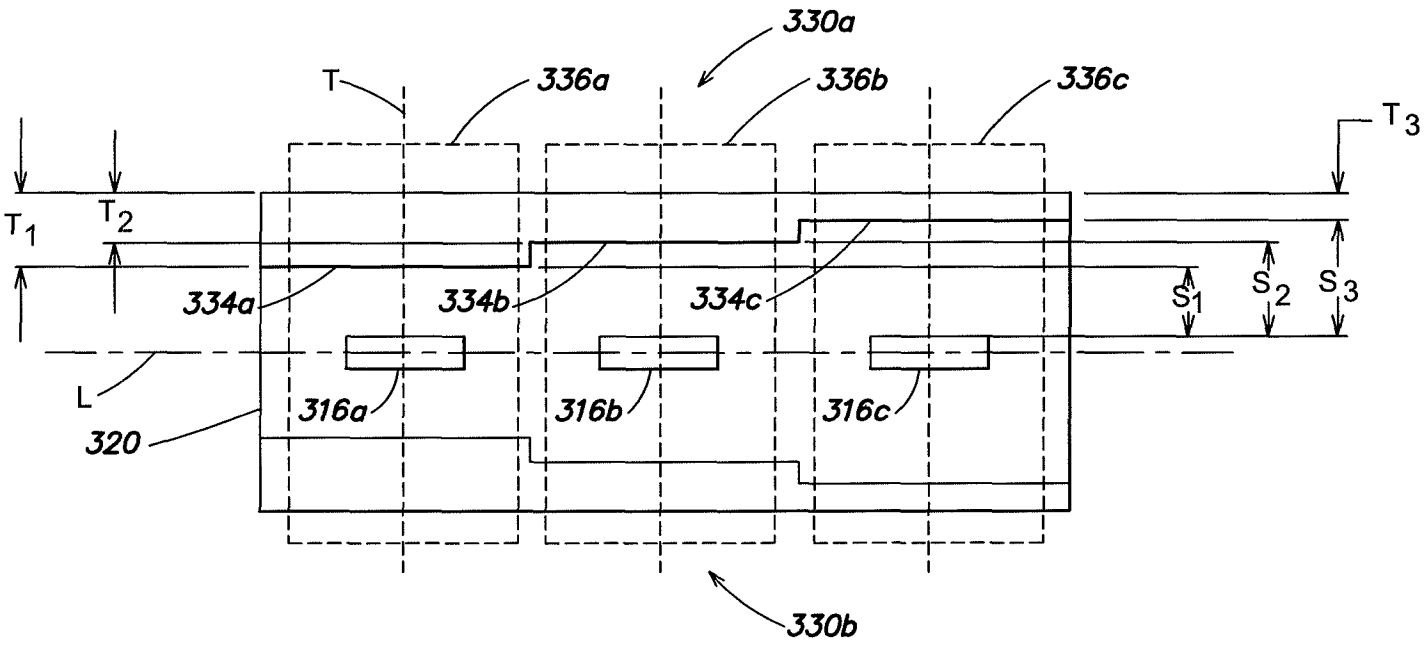
FIG. 6C is a side profile of a planar member of lossy material in accordance with some embodiments.

FIG. 6C schematically shows a partial cross section of a wafer, illustrating three conductive elements, which are of different lengths. As shown in FIG. 6C, lossy material regions 334*a*, 334*b*, 334*c* have varying thicknesses $T_1$, $T_2$, $T_3$, respectively, and different distances $S_1$, $S_2$, $S_3$ from adjacent conductive elements 316*a*, 316*b*, 316*c*, respectively. The conductive element 316*a* having the shortest electrical pathway is disposed the closest distance $S_1$ from an adjacent lossy material region 334*a* also having the greatest thickness $T_1$. Conversely, the conductive element 316*c* having the longest electrical pathway is disposed the furthest distance $S_3$ from the adjacent lossy material region 334*c* which also has the smallest thickness $T_3$. The conductive element 316*b* with an electrical pathway having a distance between that of conductive elements 316*a*, 316*c* will be positioned adjacent to a lossy material region 334*b* disposed a distance $S_2$ in between distances $S_1$, $S_3$. The lossy material region 334*b* also has a thickness $T_2$ having an amount between that of thicknesses $T_1$, $T_3$. Any suitable dimensions may be selected for the thicknesses $T_1$, $T_2$, $T_3$ of various regions 334*a*, 334*b*, 334*c* of the lossy material portion 330 and the distances $S_1$, $S_2$, $S_3$. These dimensions may be selected empirically or through electromagnetic simulation to at least partially compensate for differences in rate of loss along the conductive elements.

In some embodiments, sections of lossy material are symmetric with respect to the conductive elements within a connector. Such symmetry, for example, may be achieved by attaching lossy members, of similar configurations, on opposing side of a wafer. For example, as shown in FIG. 6C, lossy material portions 330*a* and 330*b* are symmetric with respect to longitudinal axis L, which runs along a column direction in the illustrated example. Similarly, insulative material 320 may be symmetric about conductive elements 316*a*, 316*b*, 316*c* about longitudinal axis L.

Additionally, each of conductive elements 316*a*, 316*b*, 316*c* may include symmetric regions 336*a*, 336*b*, 336*c*. For example, lossy material region 334*a* may be symmetric about a transverse axis T with respect to conductive element 316*a* within a symmetric region 336*a*. Similarly, lossy material regions 334*b*, 334*c* may be symmetric about corresponding transverse axes (not explicitly shown) with respect to conductive elements 316*b*, 316*c* within symmetric regions 336*b*, 336*c*.

In some embodiments, lossy conductive materials may be electrically insulated from the conductive contacts. For example, although not limited as such, an insulator material may be deposited around the conductive contacts and the lossy material may be deposited around the insulator material. Accordingly, in some cases, the conductive contacts are unable to contact the lossy material due to the presence of the insulator material. Despite the lossy material not being in contact with the conductive contacts, the close proximity of the lossy material with respect to the conductive contacts may provide for undesirable resonance to be suitably attenuated.

Figure 7A:
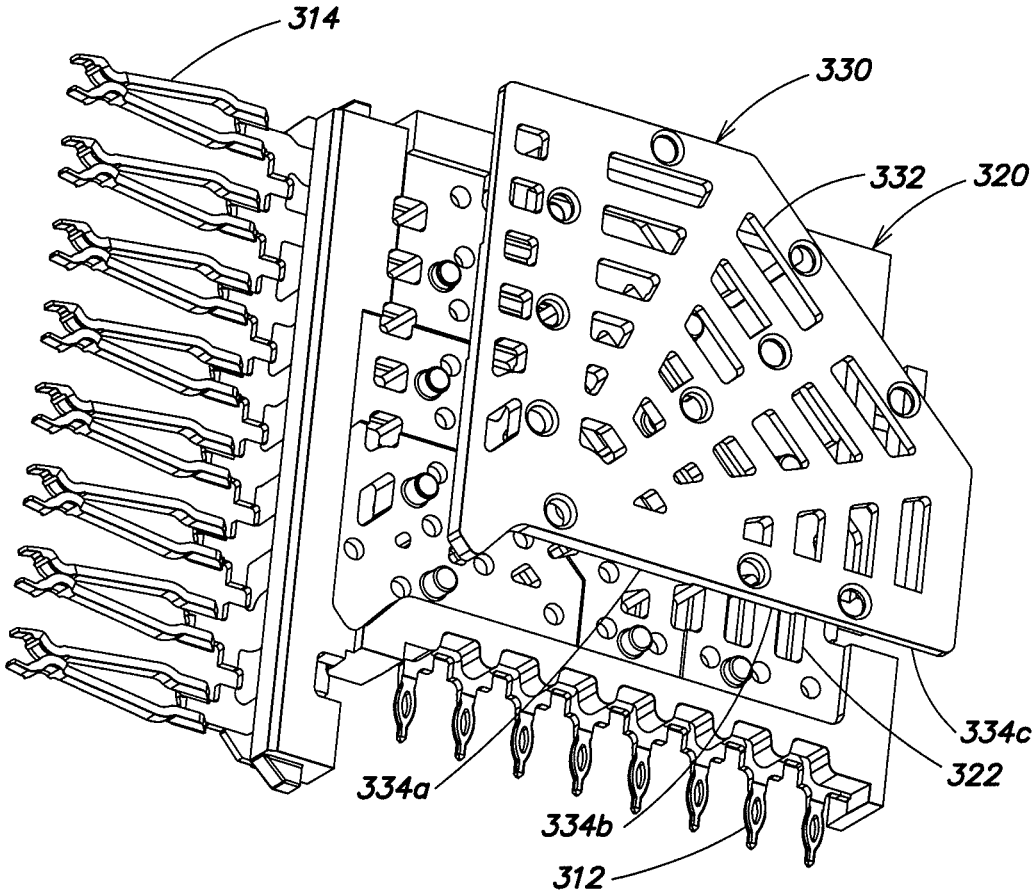
FIG. 7A is a perspective, partially exploded view of a conductive wafer in accordance with some embodiments.
Figure 7B:
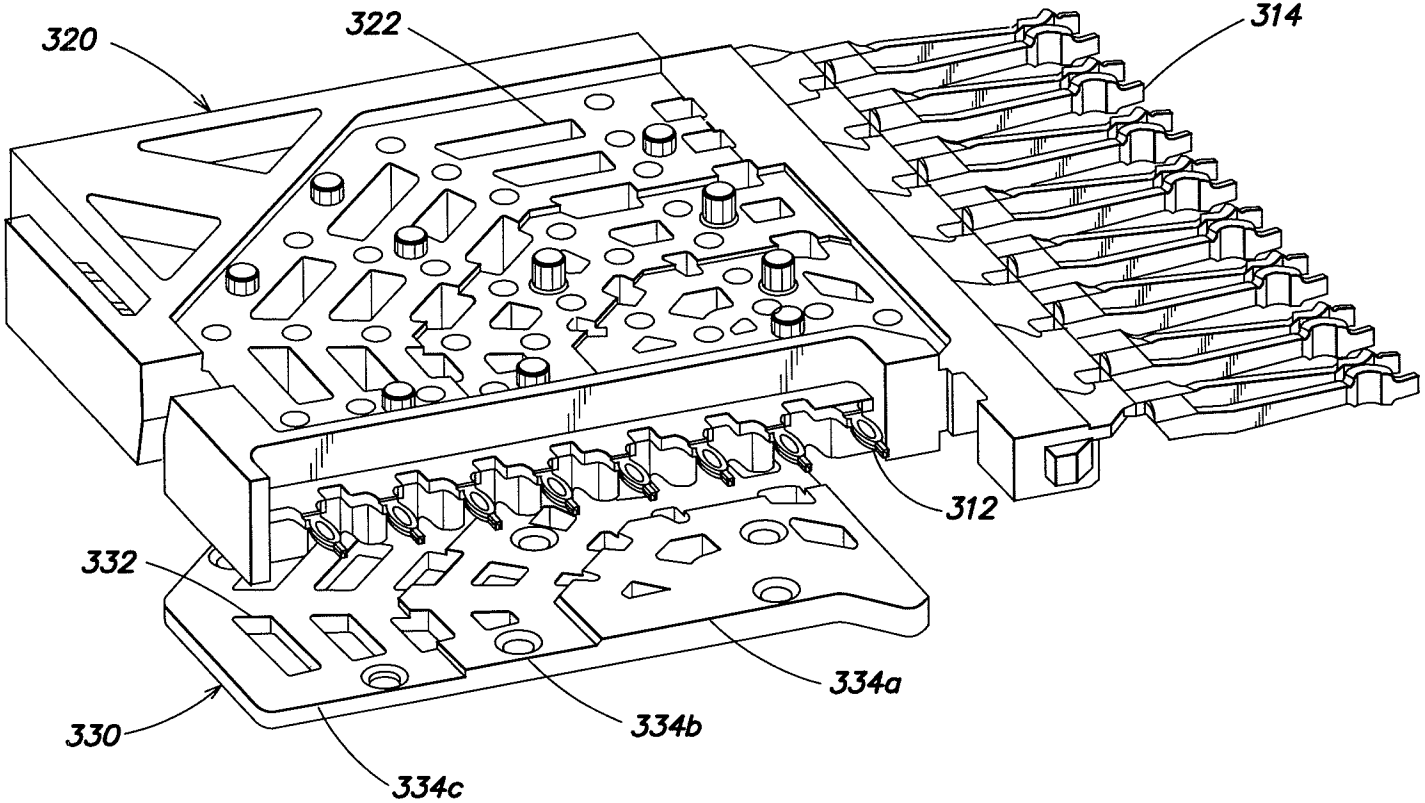
FIG. 7B is another perspective, partially exploded view of a conductive wafer.
Figure 7C:
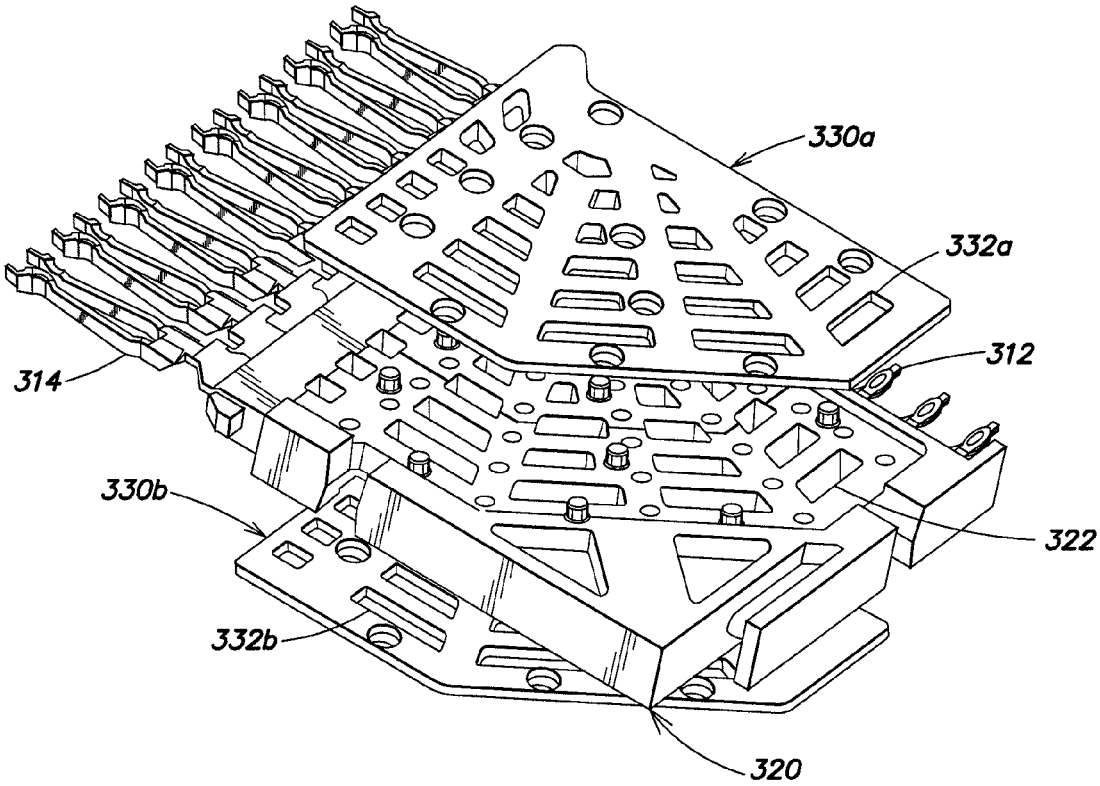
FIG. 7C is a different perspective, partially exploded view of a conductive wafer in accordance with some embodiments.

FIGS. 7A-7C illustrate embodiments of planar members of lossy material portions 330 placed on either side of a conductive wafer. A shown, the lossy inserts attached to opposing side are similarly shaped to create a symmetric distribution of lossy material on both sides of the column in the wafer.

FIG. 7C depicts first and second lossy material portions 330*a*, 330*b* placed on opposite sides of the insulative material portion 320 of the conductive wafer. Insulative material portion 320 may serve effectively as a housing for conductive elements 316 and additionally may hold the conductive elements securely in place.

Figure 8:
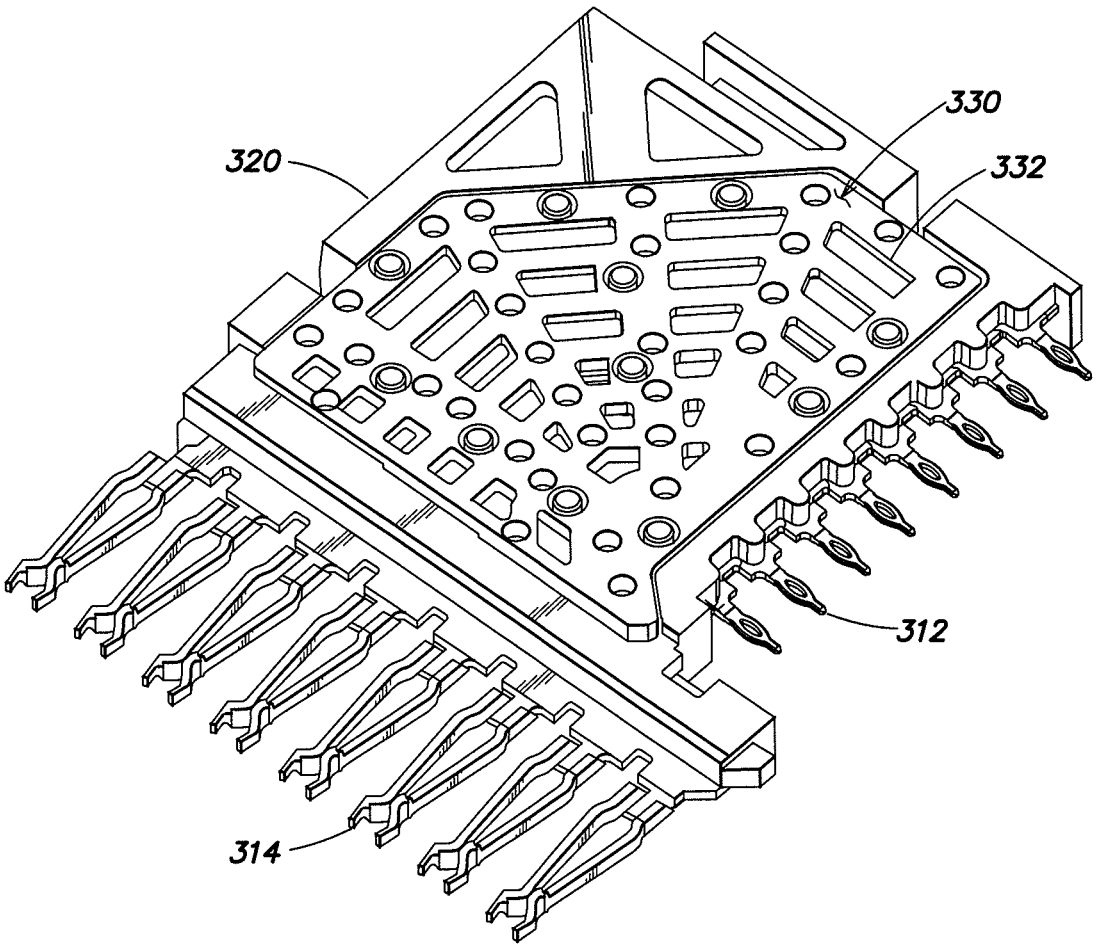
FIG. 8 is a perspective view of a conductive wafer.

In FIG. 8, lossy material portions 330*a*, 330*b* are shown attached to the insulative material portion 320 on opposite sides of the conductive wafer. In the embodiment illustrated, the lossy material portions 330*a*, 330*b* do not contact any of the conductive elements within the wafer. Accordingly, the lossy material portions 330*a*, 330*b* may be regarded as electrically floating, as they are not tied to ground. To limit capacitive coupling between signal conductors, whether in the same wafer or in an adjacent wafer, the capacitance between the lossy material portions 330*a*, 330*b* and the conductive elements may be reduced, such as by forming strips, as described above.

With lossy material portions 330*a*, 330*b* attached to a wafer as illustrated in FIG. 8, the lossy material is positioned between columns, as illustrated in FIGS. 3A and 3B. This positioning further contributes to balancing impedance in pairs formed along rows and along columns.

Also, it may be beneficial that the materials surrounding conductive elements exhibit varying effective dielectric constants. As an example, when the space between conductors is closer along columns than along rows, to achieve comparable impedances for pairs along rows and along columns, it may be desirable for the effective dielectric constant for material between conductive elements along rows to be higher than along columns. For example, the insulative material portion 320 may have a relative dielectric constant that ranges between about 2.5 and about 5, or alternatively, greater than 2.5, or greater than 3. In some embodiments, the insulative material portion 320 has a dielectric constant of 2.8. In other embodiments, the insulative material portion 320 has a relative dielectric constant of 3.4. Air gaps 322 and 332 disposed in the insulative material portions 320 may provide a dielectric constant of about 1. In some cases, including air gaps between conductive elements may provide for varying levels of effective dielectric constant in the connector system, resulting in a lower effective dielectric constant between conductive elements in the same column than between conductive elements in the same row.

Figure 9:
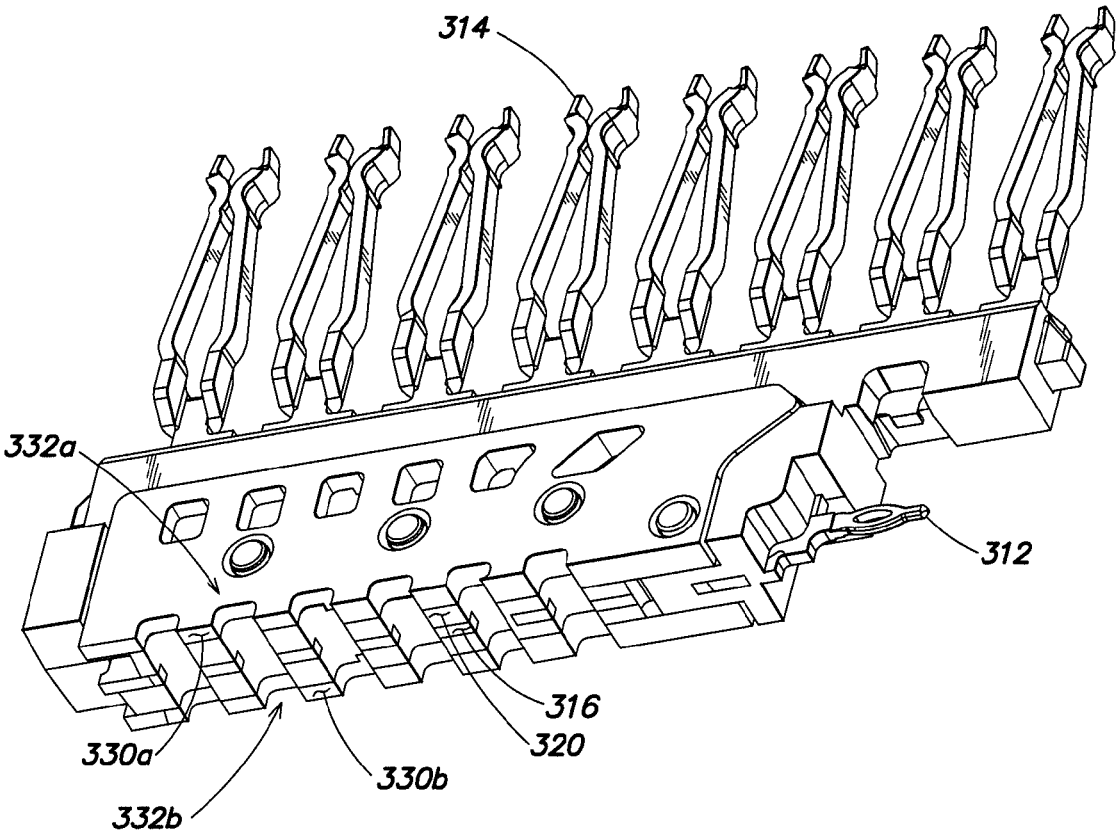
FIG. 9 is a partial cut-away view of a conductive wafer in accordance with some embodiments.

The conductive wafer shown in FIG. 9 illustrates air gaps, such as air gaps 322, 332*a*, 332*b* between conductive elements within a wafer. The air gaps reduce the effective dielectric constant of material between conductive elements 316 in the column. However, those air gaps have little effect on the effective dielectric constant between conductive elements 316 in the wafer illustrated and conductive elements that will be in an adjacent column when another wafer (as illustrated in FIG. 2) is positioned beside the wafer illustrated in FIG. 9.

FIG. 9 also illustrates various layers present in the wafer. As depicted, conductive element 316 is surrounded on opposite sides by insulative material portion 320. The insulative material portion 320, in turn, is surrounded on either side by lossy material portions 330*a*, 330*b*. Also adjacent to the conductive element 316 and incorporated in the insulative material portion 320 and lossy material portions 330*a*, 330*b* are slots defining air gaps 322, 332*a*, 332*b*. Lossy material portions 330*a*, 330*b* are symmetric about a longitudinal axis (not expressly shown) that runs through conductive elements 316.

Although not explicitly shown in the figures, lossy material may extend between conductive elements in a conductive wafer. In some embodiments, lossy material may extend between conductive elements grouped together as a conductive pair. For example, lossy material may extend into the edge-to-edge space between conductive elements. Lossy material may also extend into the broadside-to-broadside space between conductive elements.

Figure 10:
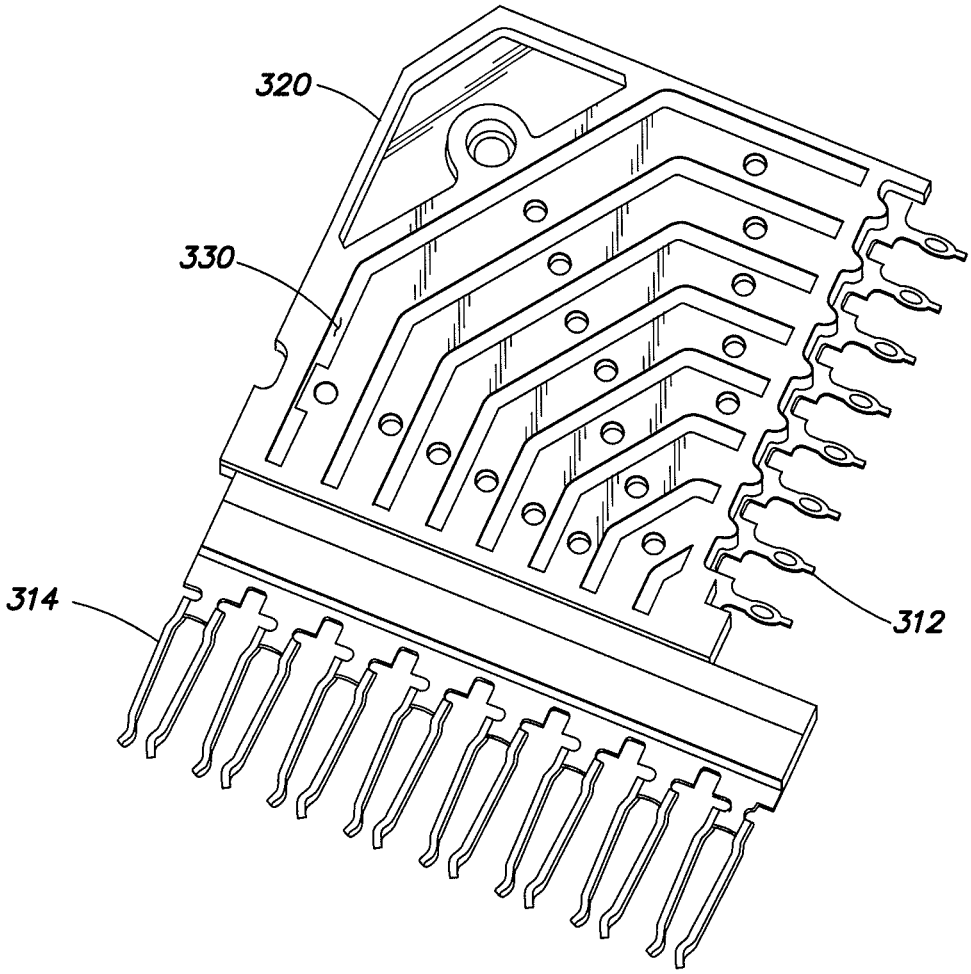
FIG. 10 is a perspective view of a conductive wafer in accordance with some embodiments.
Figure 11:
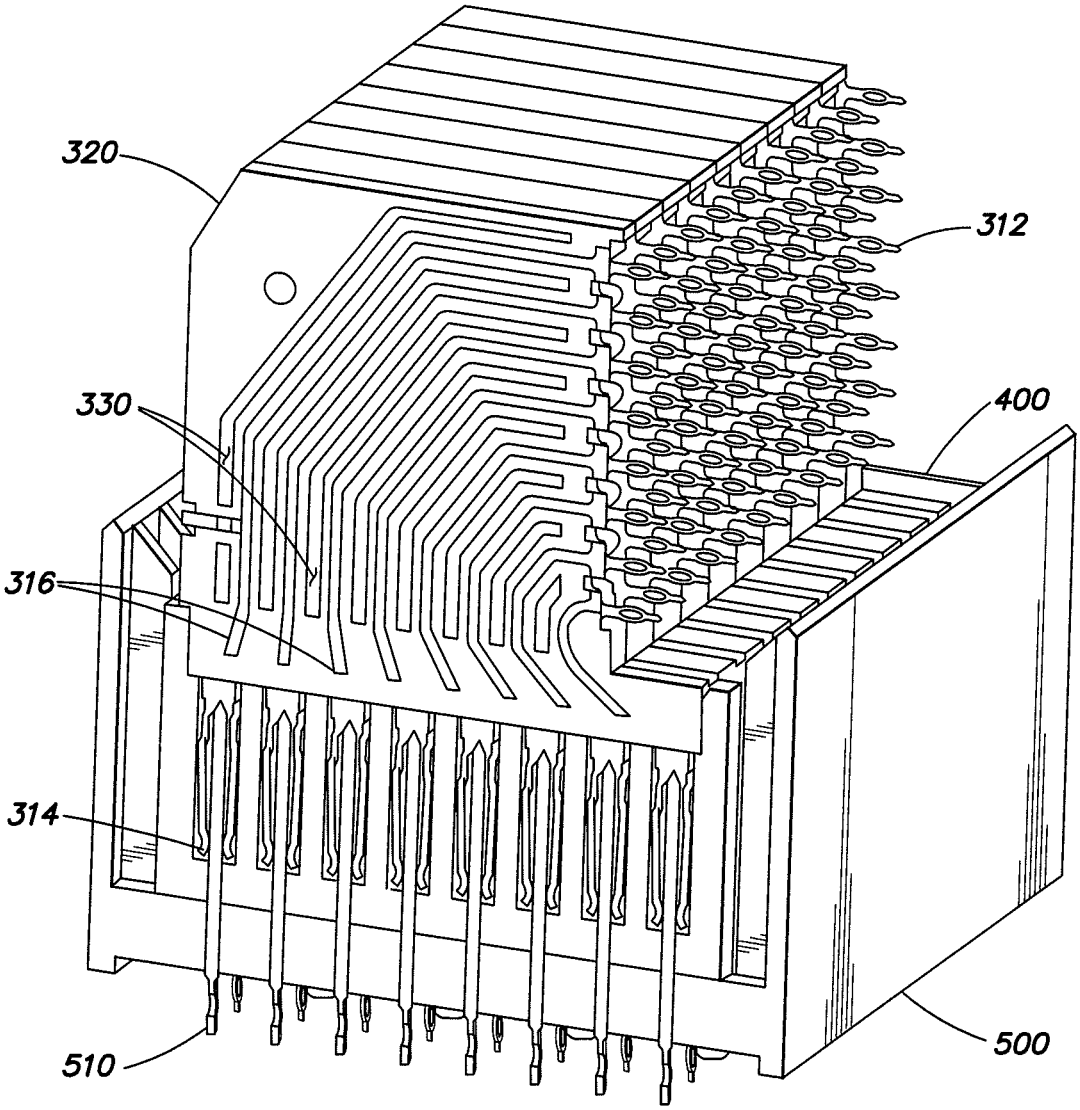
FIG. 11 is a partial cut-away view of an electrical interconnection system in accordance with some embodiments.

A different embodiment of a conductive wafer is presented in FIGS. 10 and 11 where insulative material portion 320 includes channels between conductive elements and within which lossy material 330 is located. Such channels may be continuous or discontinuous in structure, for example, gap regions may be included along conductive elements. As shown in the partially cut-away view of FIG. 11, lossy material portions 330 are positioned along and aligned between electrical pathways of conductive elements 316. Further, mating contact portions 314 are in electrical contact with backplane conductors 510 of backplane connector 500.

Figure 12:
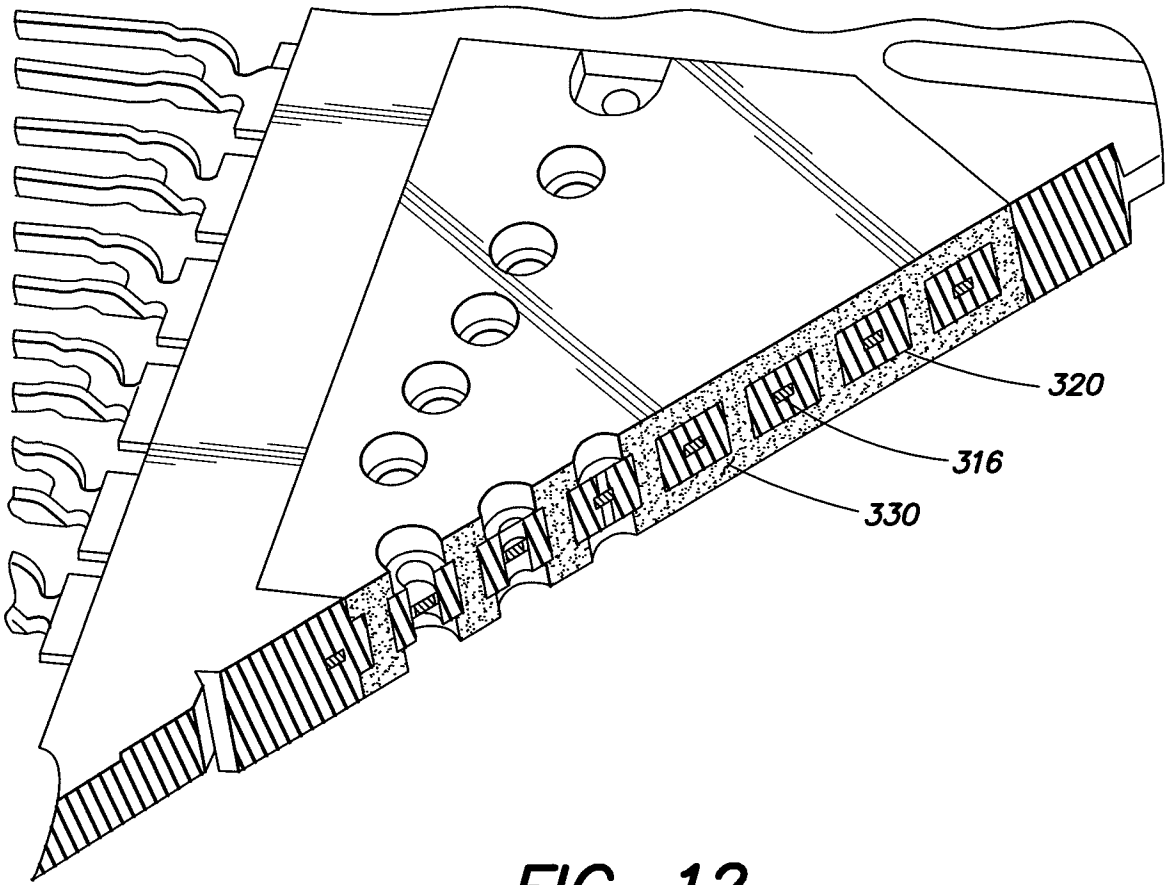
FIG. 12 is a partial cut-away view of a conductive wafer in accordance with some embodiments.

In some embodiments, as depicted in the partial cut-away view of FIG. 12, conductive elements 316 are surrounded by insulative material 320 which is, in turn, surrounded by lossy material 330. Such an arrangement may be manufactured, for example, through injection molding of the insulative material 320 around the conductive elements 316 followed by subsequent injection molding of the lossy material 330 around the insulative material 320.

Figure 13:
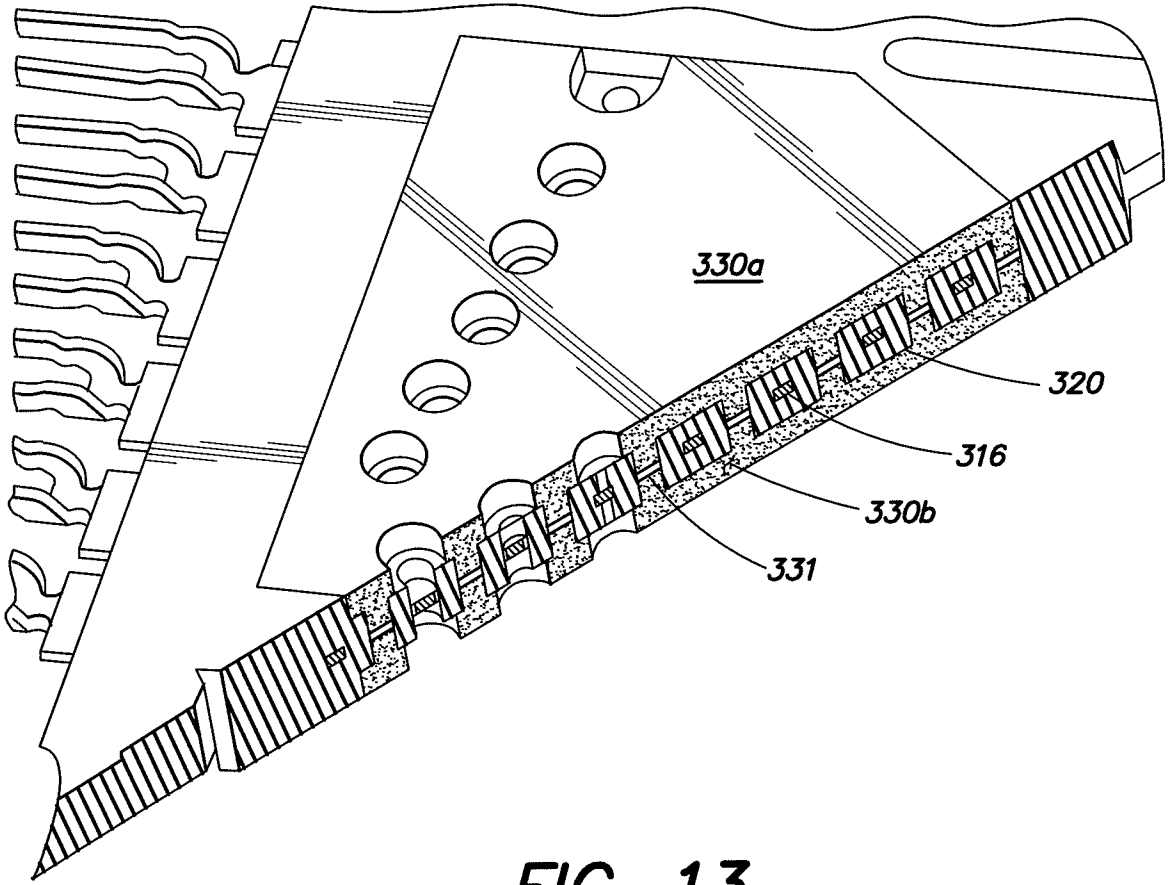
FIG. 13 is a partial cut-away view of a different conductive wafer in accordance with some embodiments.

FIG. 13 depicts a clamshell embodiment where, similar to FIG. 12, conductive elements 316 are surrounded by insulative material 320, and the insulative material 320 is also surrounded by lossy material 330*a*, 330*b*. In this embodiment, rather than being injection molded around the insulative material 320, two lossy material portions 330*a*, 330*b* are separately provided and incorporated on opposite sides of the wafer. The lossy material portions 330*a*, 330*b* come together at an interface 331 which may include a slight gap for accommodating a suitable tolerance (e.g., expansion, contraction, mechanical stresses, etc.). The lossy material portions 330*a*, 330*b* may be attached to the wafer by any suitable method, for example, by an interference and/or a snap-fit attachment on an appropriate portion of the insulative material 320.

Figure 14A:
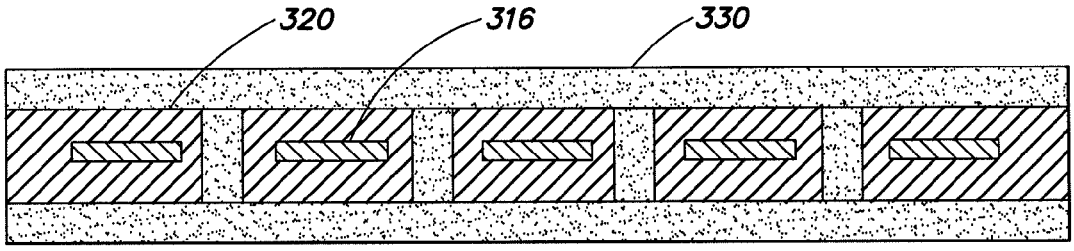
FIG. 14A is a schematic view of a cross-section taken through a conductive wafer in accordance with some embodiments.
Figure 14B:
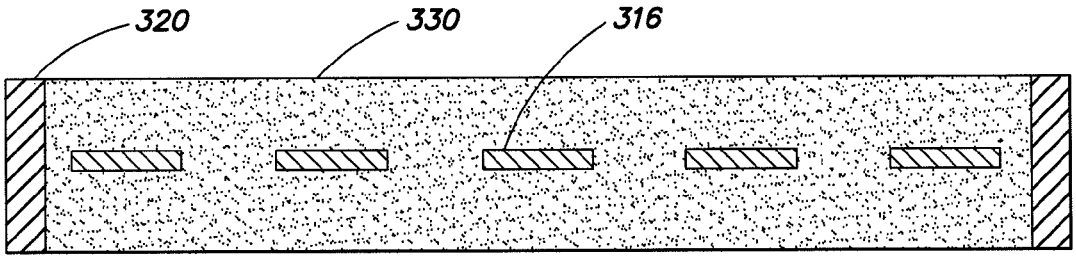
FIG. 14B is a schematic view of a cross-section taken through a different conductive wafer in accordance with some embodiments.
Figure 14C:
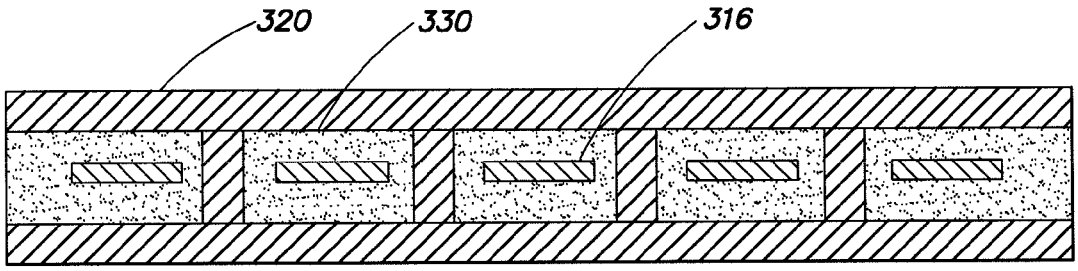
FIG. 14C is a schematic view of a cross-section taken through another conductive wafer in accordance with some embodiments.

Cross-sectional embodiments of a conductive wafer are depicted in FIGS. 14A-14C illustrate schematic arrangements of an insulative material portion 320 and lossy material portions 330 with respect to conductive elements 316 of the wafer. In FIG. 14A, conductive elements 316 are surrounded by insulative material portion 320 and the insulative material portion 320 is, in turn, surrounded by a lossy material portion 330.

In embodiments in which all, or collections of several, connector conductors touch common regions of AC lossy material, a desirable attribute of AC lossy material may include having DC resistivity properties such that AC lossy material is a bulk insulator. It may also be desirable for the AC lossy materials to have DC insulating properties so as to avoid fire hazard when pins are used for arbitrary DC power, power return, or grounding applications. Additionally, the material will also preferably have properties that avoid failure of tests such as HiPot.

In some embodiments, the AC lossy material may be an insulator resin suspending a designed concentration of conductor, semiconductor, ferrite, and/or lossy dielectric particulates resulting in desired dielectric loss properties (in both the electric and magnetic sense). Specifically, desirable electric and/or magnetic loss tangent properties are designed into such mixtures. Dielectrics such as those described in the paper by I. J. Youngs entitled "Dielectric measurements and analysis for the design of conductor/insulator artificial dielectrics" may be suitably incorporated in electrical interconnection systems described herein. In some embodiments, heterogeneous materials including one or more dispersed phases (e.g., "artificial dielectrics") may be used as dielectrics in embodiments of systems described. For example, dielectric materials of the present disclosure may include polymeric resin that is coated and/or impregnated with silver having a suitable filler fraction ranging between about 0.1 and about 0.4 (e.g., approximately 0.18). Pure substances (e.g., elements, resins, etc.), in addition to composite mixtures, may also be used if intrinsic magnetic and/or electric loss tangent properties are suitable for a particular connector application.

FIG. 14B depicts an embodiment where conductive elements 316 are surrounded by and in contact with a lossy material portion 330. An insulative material portion 320 is disposed at opposite edges of the conductive wafer. In the embodiment of FIG. 14B, the lossy material is a dielectric insulative material, as opposed to a poor conductive material, where electrical pathways remain along each conductive element 316 without the occurrence of a short circuit.

In some embodiments, AC lossy material itself may have mild or substantial conductive properties. In many embodiments, suitable electrical properties may be achieved with a conductive material in the vicinity of the conductive elements (e.g., connector pins) carrying AC data signals, so as to directly influence and purposefully attenuate the transmitted signal waveform, without contacting the conductive elements. In such a case, AC lossy material may then be encapsulated in an adequately insulating layer. Therefore, AC lossy material does not need to physically touch connector conductors. Hence, in such a configuration of AC lossy material, it is possible for the material to actually have significant DC conductivity properties if it is encapsulated in insulating material.

FIG. 14C illustrates an embodiment where conductive elements 316 are each surrounded by a lossy material portion 330 where the lossy material portions 330 are separated from one another by insulative material portion 320. Accordingly, where the lossy material of FIG. 14B is generally insulative in nature, the lossy material of FIGS. 14A and 14C may, in some cases, include a poor conductive material, although not being limited as such.

FIGS. 15-19 depict embodiments of separate conductive elements 316 of a wafer disposed adjacent to one another. Lossy material portions 330 may be arranged around a conductive element 316 in any suitable manner, including by depositing the lossy material directly on the conductive member.

Figure 15:
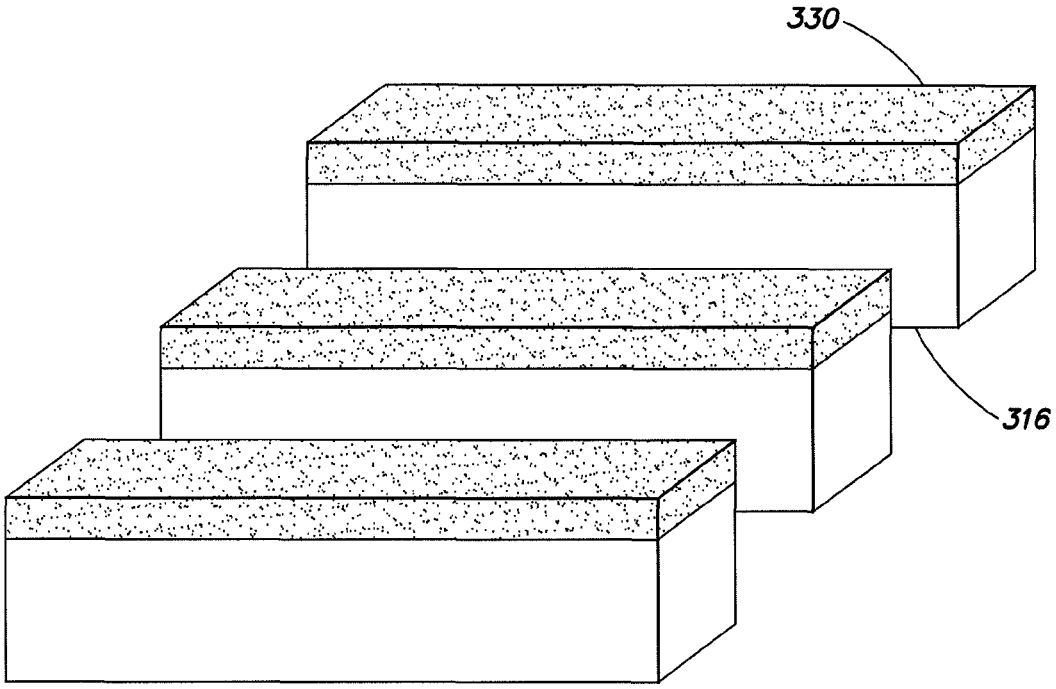
FIG. 15 is a schematic view of adjacent conductive elements and strips of lossy material disposed on the conductive elements.
Figure 16:
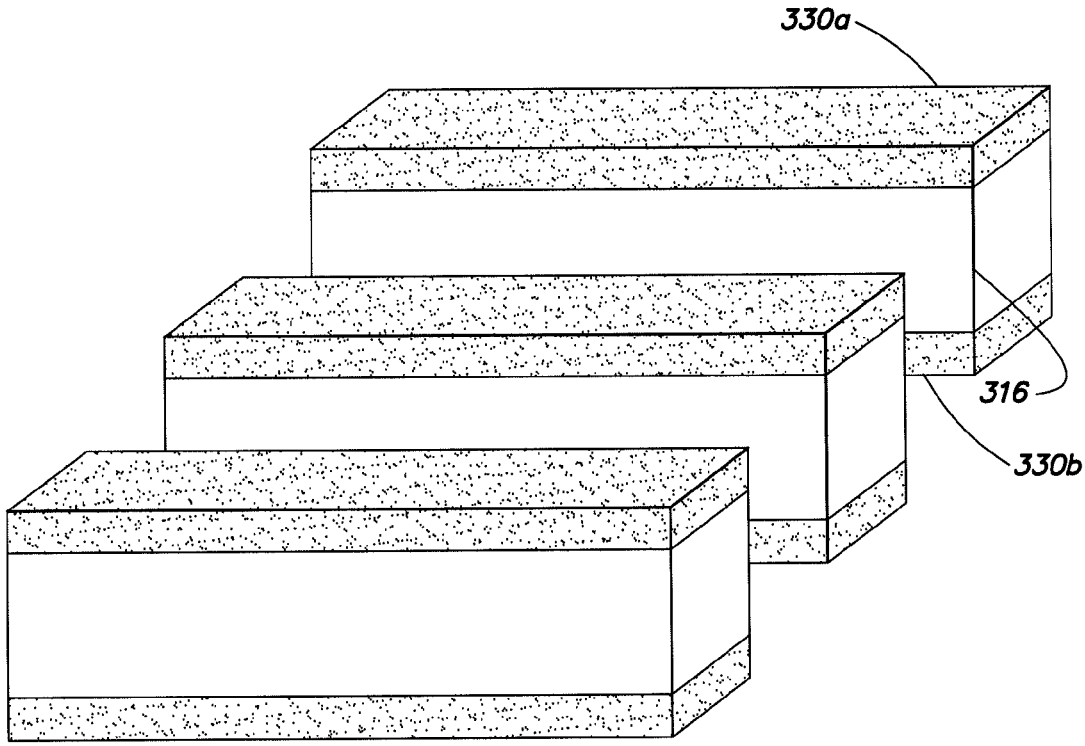
FIG. 16 is a schematic view of adjacent conductive elements and strips of lossy material disposed on opposite sides of the conductive elements.
Figure 17:
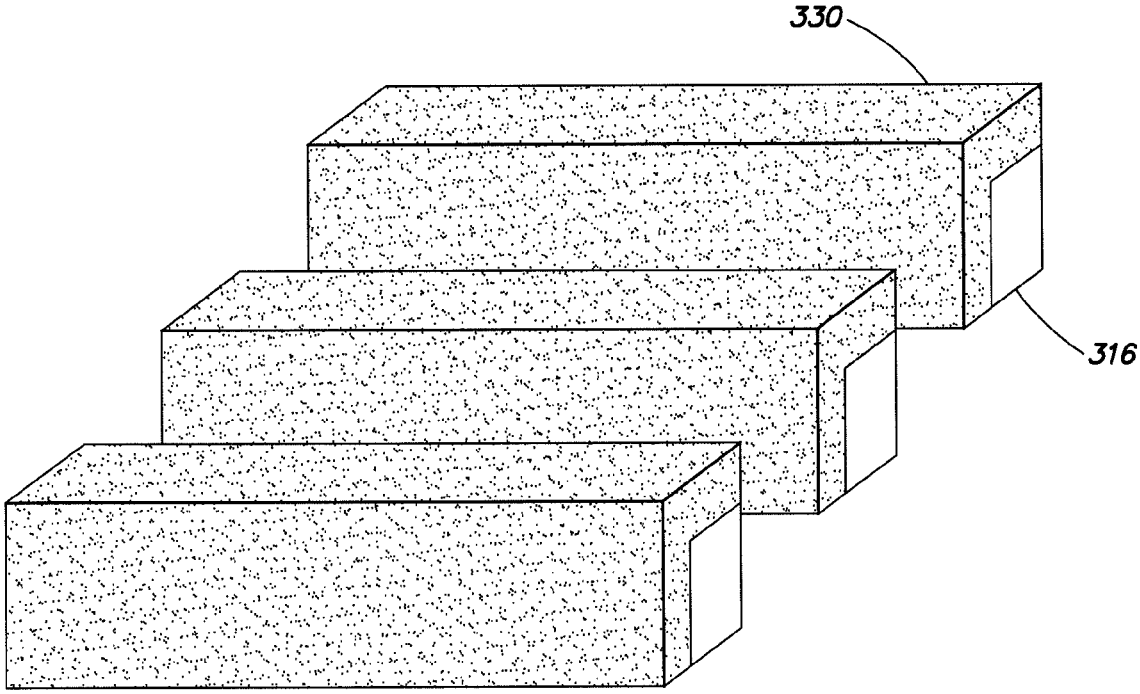
FIG. 17 is a schematic view of adjacent conductive elements and lossy material disposed on two sides of the conductive elements.
Figure 18:
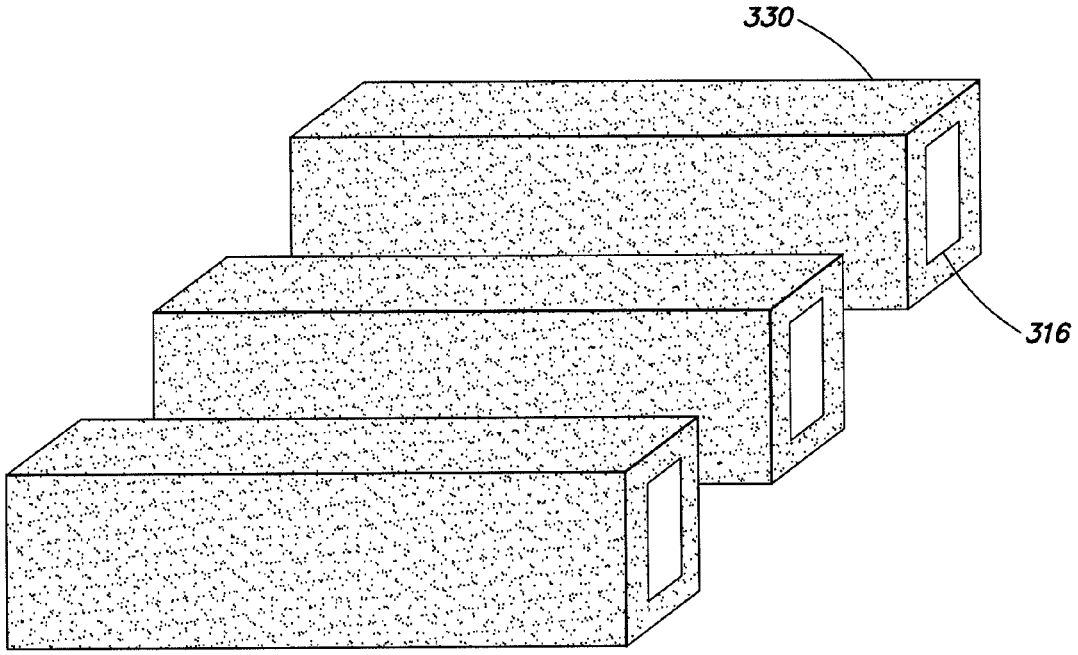
FIG. 18 is a schematic view of adjacent conductive elements and lossy material completely surrounding the conductive elements.

For example, FIG. 15 depicts an embodiment where a lossy material portion 330 is disposed on one side along the length of a conductive element 316. In FIG. 16, a first lossy material portion 330*a* is disposed along one side of a conductive element 316 and a second lossy material portion 330*b* is disposed along the opposite side of the conductive element 316. The amount of lossy material, and the percentage of the conductive element to which that lossy material is attached may be varied to provide the same amount of loss along each conductive element. FIG. 17 illustrates a lossy material portion 330 that is disposed along two adjacent sides of a conductive element 316. FIG. 18 depicts conductive element 316 that is completely surrounded by a lossy material portion 330. In some cases, and as described above, the lossy material portion 330 contacts the conductive element 316; however, in other cases, the lossy material portion 330 does not contact the conductive element 316 (e.g., an insulative material may be disposed between the lossy material and the conductive element).

Though, other configurations of lossy materials may be used to provide a desired amount of loss along one or more conductive elements. In some embodiments, one or more regions of AC lossy material may be positioned along a length of each of the multiple conductive elements in a column. As a specific example, the regions of AC lossy material may have a length, in a dimension along the length of the conductive element, of between 1 and 2 mm. To provide adequate loss, a break or gap in the conductive element may be formed and the AC lossy material may fill the break, providing an AC lossy connection across the gap.

In yet other embodiments, a lossy material may be used to form loss-producing bodies that bridge gaps formed in individual conductive leads in the lead frame or other areas. In some embodiments, gaps are formed along the path of a conductor and lossy material is inserted in the gap so that the conductive lead has an electrical pathway. In some embodiments, a lossy conductive polymer compound includes a carbon particle filler having a conductivity in the range of between about 1 and about 100 Siemens/meter, as measured in the range of 1 to 10 GHz. In some embodiments, each of the conductive elements in an open pin field connector may include the same number of such lossy bodies such that each conductive element experiences the same loss.

It can be appreciated that any suitable dimensions of the conductive lead and a corresponding gap may be incorporated. In an embodiment, conductive leads may be about 0.2 mm thick. In one embodiment, conductive leads may be about 0.8 mm in width. In some embodiments, the length of a gap may range between about 1 mm and 3 mm.

Figure 19:
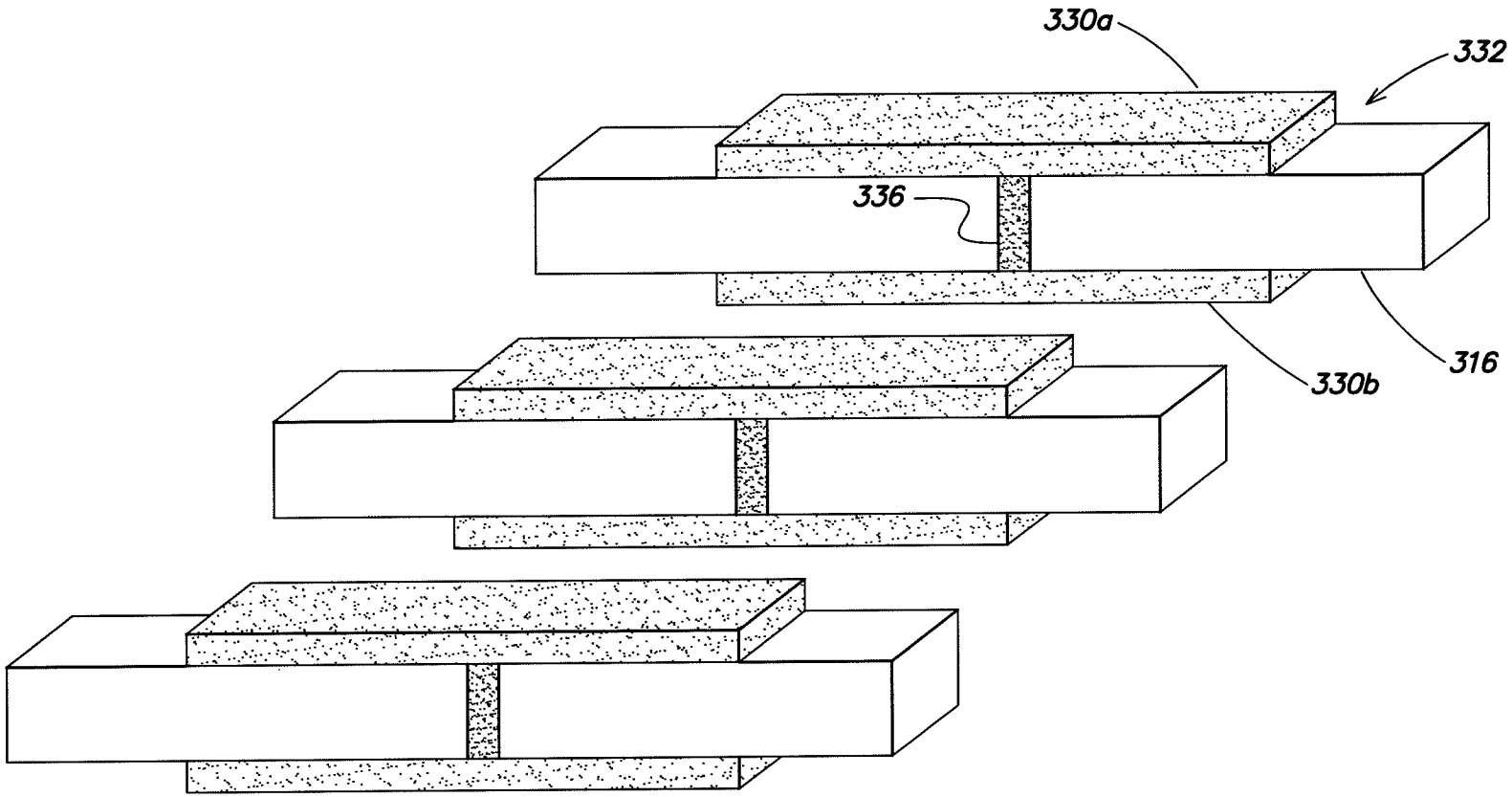
FIG. 19 is a schematic view of adjacent conductive elements and lossy material disposed on opposite sides of the conductive elements in accordance with some embodiments.

In some embodiments, as shown in FIG. 19, a conductive element 316 may include a gap region 336 that may be filled with a lossy material. In such a case, the lossy material included in gap region 336 may be conductive, albeit a poor conductor. The lossy material portions 330*a*, 330*b* disposed on either side of the conductive element 316 are not so limited and may be dielectrics and/or poor conductors. As described above, air gaps 332 may be disposed adjacent to conductive elements 316 so as to provide materials of varying dielectric constant between conductive elements.

In some embodiments, AC lossy material may be positioned at least one location along the conductive elements within a connector. In some embodiments, that location is adjacent contact tails and/or mating contact portions adapted for attachment to a printed circuit board. In some embodiments, AC lossy material may alternatively or additionally be positioned near a mating interface of the conductive elements, where the conductive elements mate with conductive elements in a second connector half.

Figure 20:
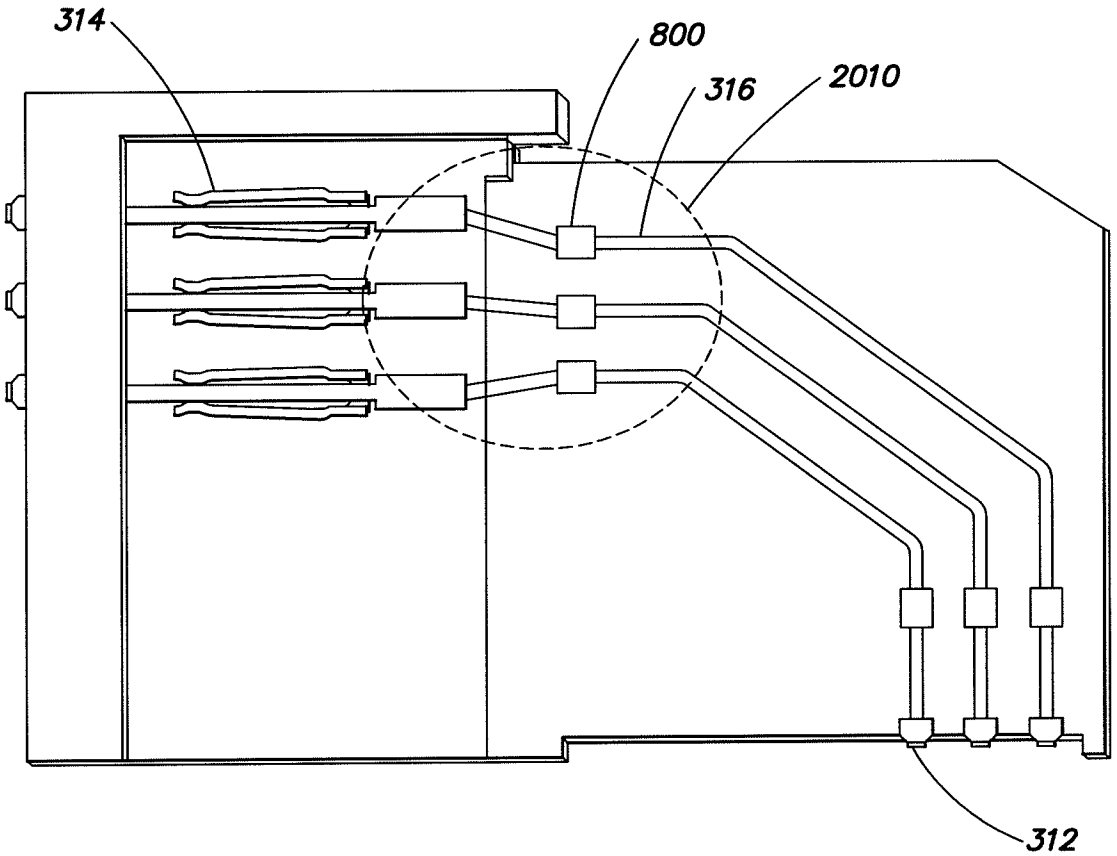
FIG. 20 is a side schematic view of a conductive wafer having a gap region along a conductive element in accordance with some embodiments.
Figure 21:
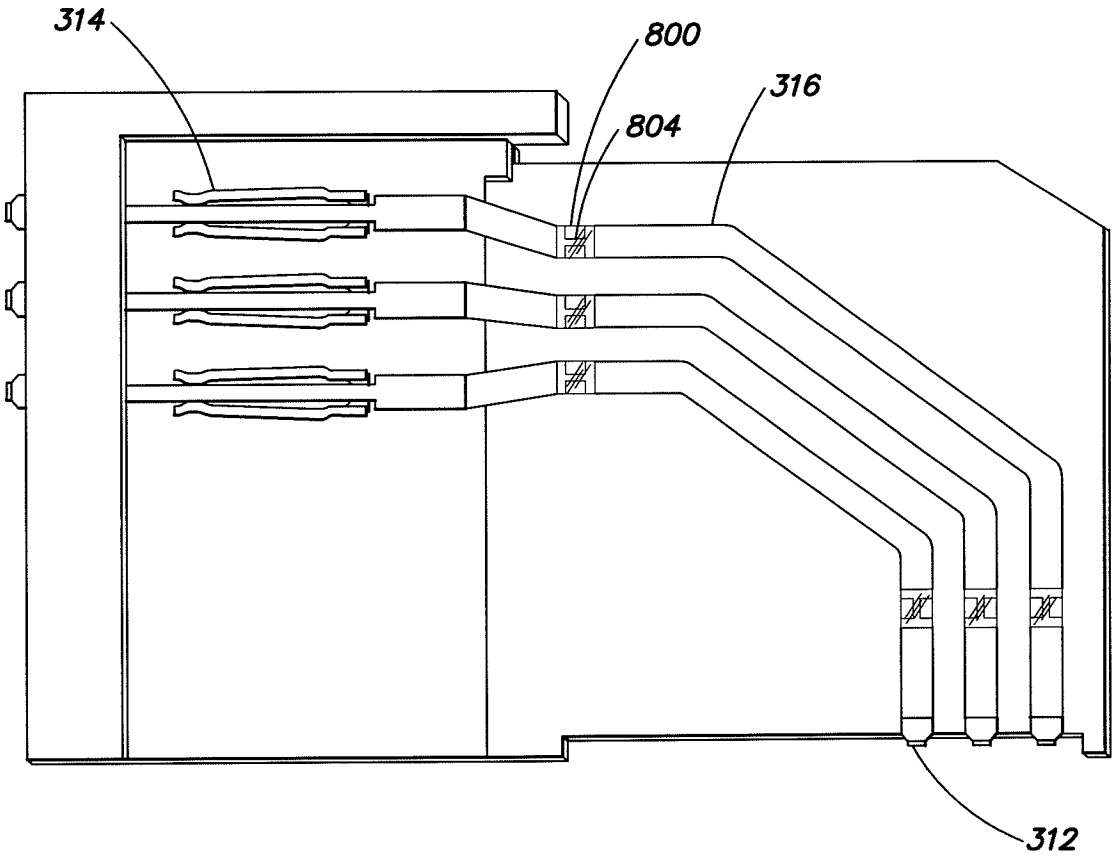
FIG. 21 is a side schematic view of a conductive wafer having a bridged gap region along a conductive element in accordance with some embodiments.
Figure 22:
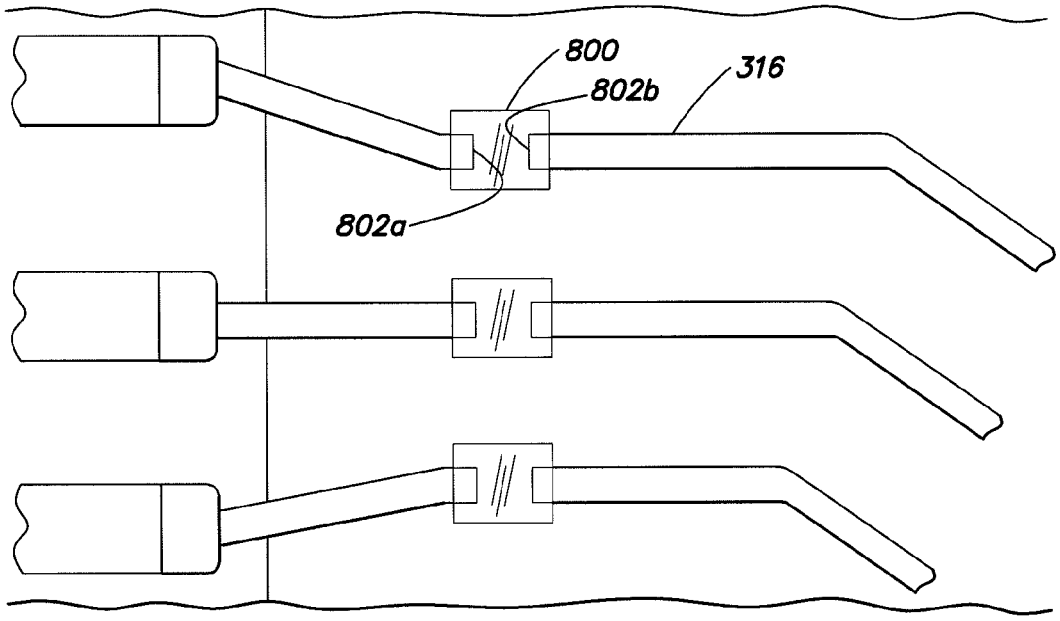
FIG. 22 is a close up side schematic view of area 2010 of FIG. 20.

In some cases, a suitable resistive element 800 may bridge a gap region along the electrical pathway of a conductive element 316. FIGS. 20-22 illustrate embodiments of a wafer having conductive elements 316 including gap regions near board attachment regions. In some embodiments, gap regions may be located at other regions along the conductive elements, or for example, near the mating interface. The distance between edges of conductive members of a conductive element in gap regions may be any suitable distance. For example, a gap region defined by the edges of conductive members of a conductive element may be between about 0.5 and 3 mm, or between about 1 mm and about 2 mm across.

The gap region may include lossy material contacting opposite edges of the conductive members in the conductive element. In this regard, the lossy material may suppress resonance effects at the gap regions.

Conductors where lossy material bridges gaps in the conductive leads may exhibit a higher DC resistance. In some cases, higher DC resistance may limit use of the conductors as power voltage or power return conductors.

Alternatively, a narrow bridging conductor of the original high conductivity lead frame material may be retained within over molded lossy conductive polymer resistive bodies. In some cases, retaining a portion of the high conductivity lead frame material may provide for lower contact DC resistance and at frequencies below 1 GHz.

It can be appreciated that any suitable dimensions of the conductive lead and a region where bridging conductor exists may be incorporated. In an embodiment, conductive leads may be about 0.2 mm thick. In one embodiment, conductive leads may be about 0.8 mm in width. Where a narrow bridging conductor is included, for some embodiments, the narrow bridging conductor may be about 0.2 mm wide. Additionally, in embodiments where a narrow bridging conductor is included, the length of the narrow bridging conductor may be in a range between about 1-10 mm, or 3-10 mm.

In cases where conductive leads include gaps or narrow bridging conductor portions, gaps or bridging conductors are included in locations that give rise to improved resonance attenuation. As such, lossy materials are useful to mitigate resonance at locations where currents are greater (e.g., current anti-node locations in the conductive lead). Currents are typically greatest near mating interfaces of the conductive lead, for example, at ends of the daughter card and backplane. In some cases, mating interfaces will give rise to lower impedances, and hence, larger currents.

In yet further embodiments, portions of the conductive elements may be narrowed, or otherwise shaped to have a reduced cross section relative to other portions of the conductive element, without creating a break. Regions of AC lossy material may be placed over the reduced cross section regions. As a specific example, these regions of AC lossy material may have a length, in a dimension along the length of the conductive element, of between 1 and 10 mm, or between 3 and 10 mm. In some embodiments, the conductive elements may have a thickness, T, and, the reduced cross section regions may have a width on the order of T. As a specific example, a conductive element may have a width of 0.8 mm and thickness of 0.2 mm. The reduced cross section regions may have a width of about 0.2 mm.

In FIG. 21, the gap region along the electrical pathway of conductive elements 316 is bridged by a metal joining core 804. In this regard, a direct electrical pathway formed by a highly conductive material (e.g., metal) continues along the conductive elements 316, which may be suitable for DC currents. However, as the frequency of the signal carried by the conductive elements 316 rises, effects of the highly conductive bridging material may be less apparent. In this way, the structure as illustrated in FIG. 21 may have little impact at DC and low frequencies, allowing any signal conductor to be used at low frequencies. Though, such a structure may provide attenuation at higher frequencies as the more of the signal energy is carried by radiation passing through the lossy portion of the structure. In this way, high frequency resonances may be damped, while still allowing any conductive element to be assigned to carry a power, ground, or low frequency signal.

Any suitable dimensions may be used to achieve the desired attenuation. In some cases, the conductive element 316 in the gap region is narrowed to between about 20% to 70% of its width along the rest of the electrical pathway. For example, a conductive element 316 having a width of about 0.8 mm and may be narrowed in the gap region to about 0.2 mm. In some embodiments, a narrowed portion in a gap region of a conductive element may have a width on the order of the thickness of the remainder of the conductive element.

In some embodiments, as shown in FIG. 22, the gap region is not bridged by a metal joining core. Rather, lossy material is included in the resistive element 800 that bridges edges 802*a*, 802*b* of the conductive elements 316 so that an electrical pathway is formed. In this regard, instead of a dielectric, the lossy material may be a poor conductor material so that current may flow from one edge 802*a* to an opposite facing edge 802*b* along the conductive element 316.

This invention is not limited in its application to the details of construction and the arrangement of components set forth in the foregoing description or illustrated in the drawings. The invention is capable of other embodiments and of being practiced or of being carried out in various ways. Also, the phraseology and terminology used herein is for the purpose of description and should not be regarded as limiting. The use of "including," "comprising," "having," "containing," or "involving," and variations thereof herein, is meant to encompass the items listed thereafter and equivalents thereof as well as additional items.

Having thus described several aspects of at least one embodiment of this invention, it is to be appreciated various alterations, modifications, and improvements will readily occur to those skilled in the art.

For example, though techniques are described that may be used in an open pin field connector, it is not a requirement that the techniques be used in that configuration.

Moreover, though a right angle daughter card connector is illustrated, the disclosed techniques may be used in a connector of any suitable form factor designed for any suitable purpose. For example, techniques as are described herein may be used in a mezzanine connector or a cable connector.

Further, though a combination of techniques for controlling electrical properties are described as used together, it is not a requirement of the invention that all of the disclosed techniques. Embodiments of the invention may be constructed in which these techniques are used alone. Other embodiments may be constructed in which these techniques are used in combinations of two or more.

Such alterations, modification, and improvements are intended to be part of this disclosure, and are intended to be within the spirit and scope of the invention. It should be appreciated that aspects of the various embodiments described above may be used separately or together in any combination. Accordingly, the foregoing description and drawings are by way of example only.

What is claimed is:

1. An electrical connector, comprising:

a plurality of columns, each column comprising a plurality of conductive elements, the plurality of columns aligned in parallel such that the plurality of conductive elements in the plurality of columns are disposed in a plurality of rows, each conductive element having a broadside portion and an edge portion, the edge portion constructed to be narrower than the broadside portion, wherein a first broadside and a second broadside of the broadside portion are joined by a first edge and a second edge of the edge portion, the first broadside and the second broadside each being wider than the first edge and the second edge; and lossy material disposed adjacent the conductive elements of each of the plurality of columns, wherein the plurality of columns and the lossy material are configured such that conductive elements provide differential signal conducting paths having a nominal impedance, and the lossy material is positioned such that signal paths formed from adjacent conductive elements in the same column have an impedance no less than 80% of the nominal impedance and signal paths formed from adjacent conductive elements in adjacent columns have an impedance no greater than 120% of the nominal impedance.

2. The electrical connector of claim 1, further comprising:

insulative material, the insulative material having a relative dielectric constant in excess of 3.

3. The electrical connector of claim 2, wherein:

the plurality of columns are aligned in parallel such that the plurality of conductive elements in the plurality of columns are disposed in a plurality of rows, with the conductive elements in the same column being aligned edge-to-edge and the conductive elements in the same row being aligned broadside-to-broadside; and the insulative material is disposed between adjacent conductive elements in the same row.

4. The electrical connector of claim 1, wherein:

the electrical connector further comprises a housing comprising a dielectric material, the housing being configured such that the effective dielectric constant of material between adjacent conductive elements in the same row is higher than an effective dielectric constant of material between adjacent conductive elements in the same column.

5. The electrical connector of claim 1, wherein for each of the plurality of columns, the lossy material is disposed symmetrically about a longitudinal axis on each side of the column.

6. The electrical connector of claim 1, wherein the nominal impedance is 100 Ohms.

7. The electrical connector of claim 1, wherein the nominal impedance is 85 Ohms.

8. The electrical connector of claim 1, wherein:

the electrical connector comprises a plurality of subassemblies aligned side-by-side, each subassembly comprising:

a column of the plurality of columns;

an insulative portion holding the column, the insulative portion having a relative dielectric constant in excess of 2.9 and openings between adjacent ones of the plurality of conductive elements of the column;

the lossy material comprises a plurality of planar members, wherein:

each planar member is disposed adjacent an insulative portion of a respective subassembly of the plurality of subassemblies, and each planar member comprises a plurality of openings formed therethrough, the openings of the lossy member aligning with the openings of the insulative portion of the respective subassembly.

9. The electrical connector of claim 8, wherein:

each planar member has a stepped profile comprising a plurality of successively increasing steps.

10. The electrical connector of claim 8, wherein:

the plurality of columns are aligned in parallel such that the plurality of conductive elements in the plurality of columns are disposed in a plurality of rows, with the conductive elements in the same column being aligned edge-to-edge and the conductive elements in the same row being aligned broadside-to-broadside; and the plurality of conductive elements in the plurality of columns are disposed and configured to provide a nominal spacing between conductive elements, with the edge-to-edge spacing of the conductive elements within each of the plurality of columns being no less than 80% of the nominal spacing and the broadside-to-broadside spacing of the conductive elements within each of the plurality of rows being no greater than 120% of the nominal spacing.

11. The electrical connector of claim 1, wherein:

at least a portion of the plurality of conductive elements each has at least one narrowed segment; and the lossy material is selectively positioned adjacent the narrowed segments of the portion of the plurality of conductive elements.

12. The electrical connector of claim 1, wherein:

at least a portion of the plurality of conductive elements each has at least one gap region ; and the lossy material is selectively positioned adjacent the gap regions of the portion of the plurality of conductive elements.

13. The electrical connector of claim 1, wherein the electrical connector is a open pin field connector.

14. The electrical connector of claim 1, wherein:

each of the plurality of conductive elements comprises a mating contact portion, a contact tail and an intermediate portion joining the mating contact portion and the contact tail; and the mating contact portions and the contact tails of the plurality of conductive elements are configured in accordance with an HM standard.

15. The electrical connector of claim 14, wherein the lossy material is electrically floating within the electrical connector relative to all of the plurality of conductive elements in all of the plurality of columns.

16. The electrical connector of claim 1, wherein:

each of the plurality of columns is held within a housing to form a wafer, each wafer comprising:

the lossy material comprising:

a plurality of strips of lossy material, each strip of the plurality of strips following a contour of a respective conductive element of the plurality of conductive elements, and a plurality of regions free of the lossy material separating adjacent strips of the plurality of strips.

17. The electrical connector of claim 16, wherein:

different ones of the plurality of strips are separated from a respective conductive element by different distances.

18. The electrical connector of claim 16, wherein:

the wafer comprises a wafer for a right angle connector such that different ones of the plurality of conductive elements are different lengths, and the lossy member is configured to provide a higher rate of loss along conductive shorter conductive elements than along longer conductive elements.

19. The electrical connector of claim 16, wherein:

the at least one lossy member comprises a planar lossy member; and the plurality of regions free of the lossy material comprise slots formed in the planar lossy member.

20. The electrical connector of claim 16, wherein:

each conductive element has a contact tail, a mating contact portion and an intermediate portion connecting the contact tails and the mating contact portion;

the contact tail and mating contact portion of each of the plurality of conductive elements in the column has the same shape and the intermediate portion of each of the plurality of conductive elements in the column has the same cross section.

21. The electrical connector of claim 16, wherein:

the at least one lossy member comprises a first planar member attached to the wafer on a first side of the column and a second planar member attached to the wafer on a second side of the column, the second side being opposite the first side.

22. The electrical connector of claim 21, wherein:

the wafer further comprises an insulative portion;

the plurality of conductive elements are held within the insulative portion; and each of the first planar member and the second planar member is held to the insulative member with projections from the insulative member passing through openings in the planar member.

23. The electrical connector of claim 21, wherein:

the first planar member comprises a first plurality of projections, each of the first plurality of projections disposed to a side of a conductive element of the plurality of conductive elements; and the second planar member comprises a second plurality of projections, each of the second plurality of projections being aligned with a projection of the first plurality of projections such that each of the plurality of conductive elements is surrounded by lossy material of the at least one lossy member.

24. The electrical connector of claim 16, wherein for each pair of adjacent conductive elements, the lossy material extends between the conductive elements of the pair.

25. The electrical connector of claim 16, wherein the lossy material comprises a lossy insulator and the lossy material contacts each of the plurality of conductive elements in the column.

26. The electrical connector of claim 16, wherein the lossy insulator comprises an insulative resin and ferromagnetic particles.

27. The electrical connector of claim 16, wherein each of the plurality of strips of lossy material is disposed on the respective conductive element.

28. The electrical connector of claim 27, wherein each of the plurality of conductive elements has at least two strips of lossy material disposed thereon.

29. The electrical connector of claim 27, wherein:

each of the plurality of conductive elements has a first strip of lossy material disposed on a first broadside and a second strip of lossy material disposed on a second broadside.

30. The electrical connector of claim 16, in combination with a plurality of like wafers and a housing portion, wherein each of the plurality of conductive elements of each of the plurality of wafers comprises a mating contact portion that is inserted in the housing portion.

31. The electrical connector of claim 16, wherein each of the at least one lossy members is a unitary member comprising the plurality of strips and a plurality of segments interconnecting the plurality of strips.

32. An electrical connector comprising:

a plurality of columns, each column comprising a plurality of conductive elements;

a plurality of insulative regions, each insulative region being associated with a respective column;

lossy material disposed in a plurality of lossy regions, the plurality of lossy regions being adjacent to respective conductive elements in respective columns of the plurality of columns, wherein for each of the plurality of columns:

the respective insulative region is symmetrically disposed on a first side of the column and a second side of the column about a longitudinal axis; and a first lossy region is disposed on the first side of the column and a second lossy region is disposed on the second side of the column, the second lossy region having a symmetrical structure about the longitudinal axis with respect to the first lossy region.

33. The electrical connector of claim 32, wherein:

each of the plurality of lossy regions comprises a plurality of strips of lossy material, each of the strips following a contour of a conductive element in a respective column.

34. The electrical connector of claim 33, wherein each of the plurality of lossy regions comprises a lossy member.

35. The electrical connector of claim 34, wherein the lossy member comprises a unitary lossy member comprising a plurality of segments joining the plurality of lossy strips.

36. The electrical connector of claim 32, wherein the plurality of columns comprises a plurality of conductive elements disposed in rows, the plurality of conductive elements having a uniform center-to-center spacing along the rows and along the columns.

37. The electrical connector of claim 36 in combination with a printed circuit board, the printed circuit board comprising a plurality of pairs of traces carrying electrical signal in excess of 8 Gbps, wherein a first pair of the plurality of pairs is connected to a pair of conductive elements along a row and a second pair of the plurality of pairs is connected to a pair of conductive elements along a column.

38. The electrical connector of claim 37, wherein the center-to-center spacing is 2 mm or less.

39. An electrical connector, comprising:

an insulative support;

a plurality of columns of conductive elements, each of the plurality of columns comprising a plurality of conductive elements coupled to the insulative support;

lossy material held by the insulative support adjacent to and separated from a portion of the plurality of conductive elements of respective columns of the plurality of columns of conductive elements, wherein for each of the plurality of columns:

the portion of the plurality of conductive elements comprises at least a first conductive element, a second conductive element and a third conductive element, and the lossy material is separated from the first conductive element by a first distance, the lossy material is separated from the second conductive element by a second distance greater than the first distance, and the lossy material is separated from the third conductive element by a third distance greater than the second distance.

40. The electrical connector of claim 39, wherein the first conductive element is shorter than the second conductive element and the second conductive element is shorter than the third conductive element.

41. The electrical connector of claim 40, wherein the connector comprises a right angle connector.

42. The electrical connector of claim 39, wherein the lossy material comprises a plurality of planar members, each planar member adjacent a column of conductive elements.

43. The electrical connector of claim 42, wherein:

the connector comprises a plurality of wafers, each wafer comprising an insulative portion;

conductive elements of a column of the plurality of columns of conductive elements are at least partially disposed within the insulative portion.

44. The electrical connector of claim 39, further comprising:

an insulative portion, wherein the insulative portion has a relative dielectric constant in excess of 3.

45. The electrical connector of claim 39, wherein:

each conductive element comprises a contact tail, a mating contact portion and an intermediate portion joining the contact tail and the mating contact portion, wherein at least a portion of the plurality of conductive elements each has an intermediate portion having at least one narrowed portion; and the lossy material comprises a plurality of regions of lossy material, each region being disposed on a conductive element of the plurality of conductive elements adjacent a narrowed portion.

46. The electrical connector of claim 45, wherein:

each of the conductive elements has a first region with a first width; and the at least one narrowed portion comprises a second region with a second width, the second width being between 20% and 50% of the first width.

47. The electrical connector of claim 45, wherein:

each of the conductive elements has a first narrowed portion and a second narrowed portion, the first narrowed portion being adjacent the contact tail and the second narrowed portion being adjacent the contact tail.

48. An electrical connector, comprising:

a plurality of columns, each column comprising a plurality of conductive elements; and lossy material disposed adjacent the conductive elements of each of the plurality of columns, wherein the plurality of columns and the lossy material are configured such that conductive elements provide differential signal conducting paths having a nominal impedance, with signal paths formed from adjacent conductive elements in the same column having an impedance no less than 80% of the nominal impedance and signal paths formed from adjacent conductive elements in adjacent columns having an impedance no greater than 120% of the nominal impedance;

wherein the plurality of columns are aligned in parallel such that the plurality of conductive elements in the plurality of columns are disposed in a plurality of rows, with the conductive elements in the same column being aligned edge-to-edge and the conductive elements in the same row being aligned broadside-to-broadside; and the plurality of conductive elements in the plurality of columns are disposed and configured to provide a nominal spacing between conductive elements, with the edge-to-edge spacing of the conductive elements within each of the plurality of columns being no less than 80% of the nominal spacing and the broadside-to-broadside spacing of the conductive elements within each of the plurality of rows being no greater than 120% of the nominal spacing.

* * * * *